US010221616B2

(12) United States Patent
Gravel

(10) Patent No.: US 10,221,616 B2
(45) Date of Patent: Mar. 5, 2019

(54) MAGNETICALLY MOUNTABLE SEAL

(71) Applicant: 9519785 Canada Inc., Gatineau (CA)

(72) Inventor: Patrick Gravel, Val des Monts (CA)

(73) Assignee: 9519785 CANADA INC., Gatineau, Quebec (CA)

( * ) Notice: Subject to any disclaimer, the term of this patent is extended or adjusted under 35 U.S.C. 154(b) by 0 days.

(21) Appl. No.: 15/400,981

(22) Filed: Jan. 7, 2017

(65) Prior Publication Data

US 2017/0260800 A1 Sep. 14, 2017

(30) Foreign Application Priority Data

Jan. 8, 2016 (CA) ..... 2916964

(51) Int. Cl.
*E06B 7/16* (2006.01)
*E06B 7/22* (2006.01)
*E06B 7/23* (2006.01)

(52) U.S. Cl.
CPC ..... *E06B 7/22* (2013.01); *E06B 7/2305* (2013.01)

(58) Field of Classification Search
CPC ..... E06B 7/22
USPC ..... 49/506, 478.1
See application file for complete search history.

(56) References Cited

U.S. PATENT DOCUMENTS 2,249,424 A * 7/1941 Hanington ..... E06B 7/22 206/813
2,611,158 A 9/1952 Gregory
2,959,832 A * 11/1960 Baermann ..... A45C 13/1069 174/110 A
3,469,349 A 9/1969 Multer
3,865,914 A 2/1975 Nahr
4,694,552 A 9/1987 Ecker et al.
4,974,366 A 12/1990 Tizzoni
(Continued)

FOREIGN PATENT DOCUMENTS

CA 2871391 A1 11/2013
DE 102011122924 A1 9/2013
(Continued)

OTHER PUBLICATIONS

Portaseal full product brochure for Magnet-Stop product, retreived from http://portaseal.com/brochures/4p.pdf.

*Primary Examiner* — Jerry E Redman
(74) *Attorney, Agent, or Firm* — PatentAgency.ca; Luis P. Estable

(57) ABSTRACT

Disclosed is a magnetically mountable seal, and method of use thereof. The seal is capable of sealing a gap between a door, and either its frame or a second door. The magnetically mountable seal comprises a magnetic portion, magnetically attached to a surface; and a seal portion secured to the magnetic portion. The method of use comprises the steps of: (a) magnetically attaching the magnetic portion to one of the first door, its frame, and the second door; and (b) securing the sealing portion so that the sealing portion covers the gap when the first door is in a closed position and does not interfere with the functionality of the first door when the first door is in an open position. Improved energy efficiency around the gap reduces energy consumption. The sealing portion can be a thermal barrier, acoustic barrier, hermetic, odor barrier, contagion barrier, and fire barrier.

8 Claims, 26 Drawing Sheets

(56) References Cited

U.S. PATENT DOCUMENTS

| | | | | | |
|---|---|---|---|---|---|
| 5,161,346 | A * | 11/1992 | Olson | B29C 33/16 | 156/272.4 |
| 5,371,946 | A | 12/1994 | Cameron | | |
| 6,202,353 | B1 | 3/2001 | Giacomelli | | |
| 6,705,048 | B2 | 3/2004 | Simon | | |
| 2004/0000096 | A1* | 1/2004 | Simon | E06B 7/16 | 49/478.1 |
| 2006/0064937 | A1* | 3/2006 | Danczek | E06B 7/22 | 49/475.1 |
| 2009/0307982 | A1* | 12/2009 | Romberg | B63B 19/14 | 49/478.1 |
| 2014/0318022 | A1* | 10/2014 | Bell | E06B 7/16 | 49/478.1 |
| 2015/0159425 | A1* | 6/2015 | Algar | E06B 7/28 | 52/202 |
| 2016/0214047 | A1* | 7/2016 | Fukuhara | B03C 1/0332 | |
| 2017/0360221 | A1* | 12/2017 | Artwohl | A47F 3/125 | |

FOREIGN PATENT DOCUMENTS

| | | | | |
|---|---|---|---|---|
| EP | 2241711 | A1 | 10/2010 | |
| EP | 2706183 | A2 | 3/2014 | |
| EP | 2933423 | A1 | 10/2015 | |
| FR | 2258510 | A1 | 8/1975 | |
| FR | 2996581 | B1 | 11/2015 | |
| GB | 1089738 | A | 11/1967 | |
| GB | 2001691 | A | 2/1979 | |
| GB | 1580261 | A | 11/1980 | |
| GB | 2048350 | A | 12/1980 | |
| GB | 2063340 | A * | 6/1981 | E06B 7/2314 |
| GB | 2084230 | A | 4/1982 | |
| GB | 2138060 | B | 10/1984 | |
| GB | 2427428 | A | 12/2006 | |
| JP | 8218745 | A | 8/1996 | |
| JP | 2012117264 | A | 6/2012 | |
| KR | 101547911 | B1 | 9/2015 | |
| NL | 8001549 | A1 | 10/1981 | |
| WO | 8000264 | A1 | 2/1980 | |
| WO | 9927220 | A1 | 6/1999 | |
| WO | 2013127495 | A1 | 9/2013 | |

* cited by examiner

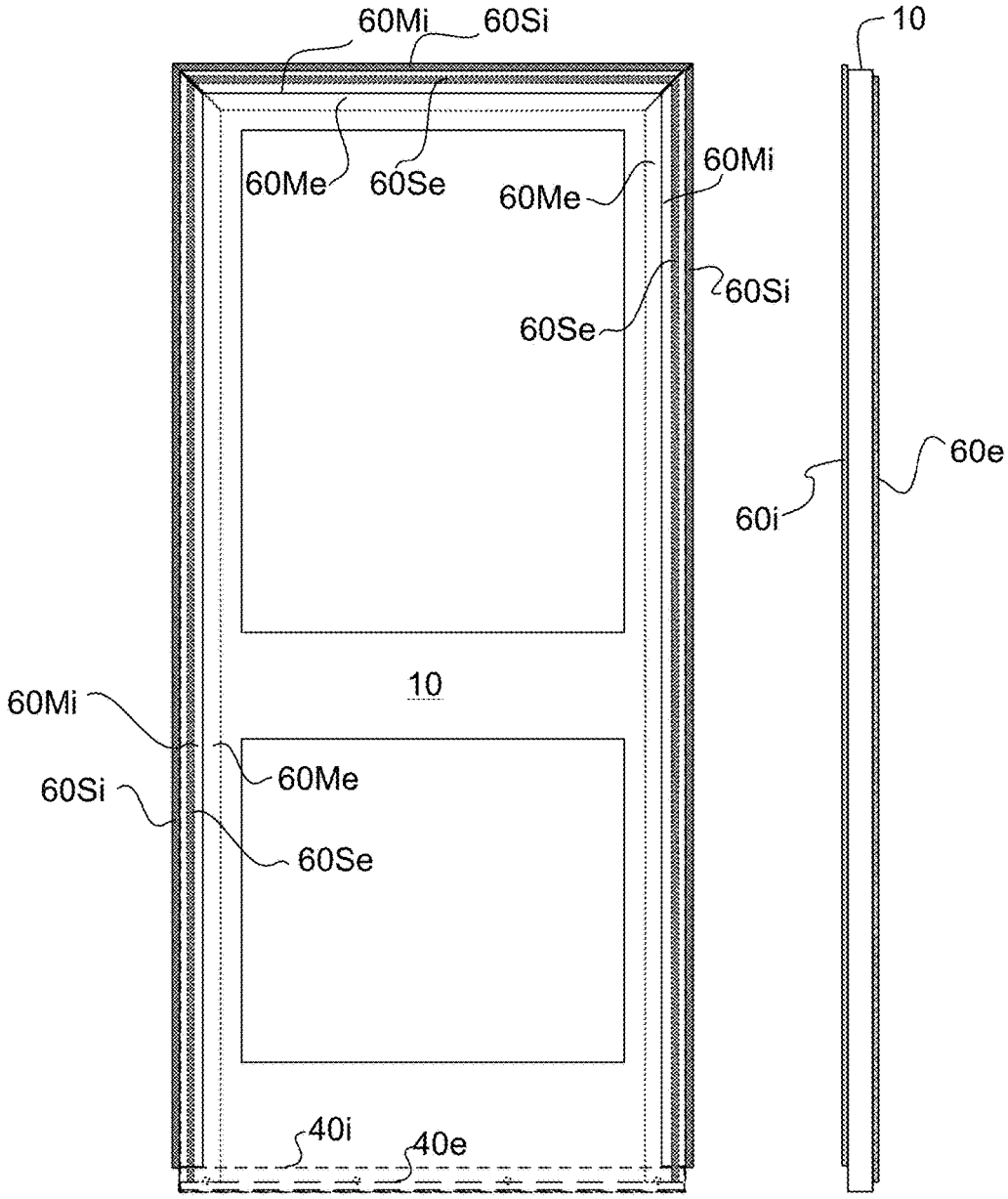
FIG. 18A
FIG. 18C
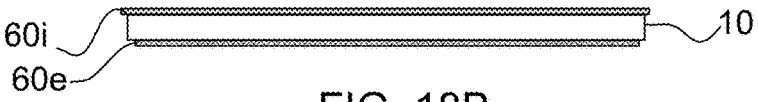
FIG. 18B

MAGNETICALLY MOUNTABLE SEAL

FIELD OF TECHNOLOGY

The present application relates generally to the sealing between a door and its frame or another door and more particularly to a magnetically mountable seal for improving the sealing of the gap between a door and its frame, or between a door and another door, when the door is closed.

BACKGROUND OF THE APPLICATION

U.S. Pat. No. 6,705,048 entitled "MAGNETIC WEATHERSTRIP" filed in the United States by David Simon addresses the problem of the magnetic fixing of a weatherstrip to a door or its frame without damaging them. Simon teaches us a weatherproofing assembly for sealing cracks between a door and a frame associated with the door, and a method of using the weatherstrip assembly. The assembly provides a flexible magnetic strip for sealing the cracks. The strip magnetically attaches to one of the door and the frame such that an overhang portion extends therebeyond. When the door is in a closed position, the overhang portion lies overtop of the cracks. Additionally, the strip may magnetically attach to the other of the door and the frame, thereby better sealing the cracks.

Despite the fact that Simon's magnetic weatherstripping addresses the problem of fixing a weatherstripping to a door or its frame, there are opportunities for improvements, sealing the gap between a door and its frame or another door once the door is closed, as well as to the operation of the door once opened.

SUMMARY

According to a first aspect of the present application, there is provided: a magnetically mountable seal capable of sealing a gap between a first door including a first surface and either the frame associated with the first door or a second door, the frame or the second door including a second surface positioned relative to the first surface in one of a substantially parallel orientation and a substantially perpendicular orientation when the first door is closed. The magnetically mountable seal comprising: a magnetic portion adapted to contact and magnetically attach to one of the first and second surfaces; and a sealing portion fixed to the magnetic portion capable of sealing the gap between the first door and the other of the associated frame and the second door.

In some alternate embodiments of the first aspect, the first surface comprises a metallic material such that said magnetic portion magnetically secures to said first surface; the second surface comprises a metallic material such that said magnetic portion magnetically secures to said second surface; the sealing portion is so fixed as to be capable of covering the gap; at least a portion of the magnetically mountable seal is covered with a vinyl layer; the first door comprises an inner surface, an opposite outer surface and an edge surface perpendicular to and positioned between the inner surface and the outer surface, and wherein the first surface is one of the inner surface of the first door and the outer surface of the first door; the second door comprises an inner surface, an opposite outer surface and an edge surface perpendicular to and positioned between the inner surface and the outer surface, and wherein the second surface is one of the inner surface of the second door and the outer surface of the second door; the frame comprises an inner surface, an opposite outer surface and an edge surface perpendicular to and positioned between the inner surface and the outer surface, and wherein the second surface is one of the inner surface of the frame and the outer surface of the frame; one of the magnetic portion and the sealing portion comprises at least one cutout portion adapted to receive at least one of a hinge, a handle, and a lock; and the sealing portion comprises a material which includes at least one of a thermal-insulating material, acoustic-dampening material, hermetic material, odor-reducing material, contagion-limiting material barrier, fire-retarding material.

According to a second aspect of the present application, there is provided: a method of using a magnetically mountable seal having a magnetic portion and a sealing portion for insulating a gap between a first door and either the frame associated with the first door and a second door, said method comprising the steps of: (a) magnetically attaching the magnetic portion to one of a first surface of the first door and a second surface of one of the frame associated with the first door and a second door, the second surface positioned relative to the first surface in one of a substantially parallel orientation and a substantially perpendicular orientation to the first surface; and (b) securing the sealing portion so that the sealing portion covers the gap when the first door is in a closed position and does not interfere with the functionality of the first door when the first door is in an open position.

In some alternate embodiments of the second aspect: a metallic material is included in one of said first surface and the second surface, and wherein step (a) further comprises the step of fixing said magnetic portion using the metallic material; the sealing portion extends beyond the perimeter of said first door to bear against one of the frame and the second door when said first door is in a closed position; in step (b) the sealing portion extends within the perimeter of said first door to abut against one of the frame and the second door when said first door is in a closed position; in step (b) the sealing portion is substantially on the perimeter of said first door for bearing against one of the frame and the second door when said first door is in a closed position; (c) moving said first door from the closed position to an open position, thereby moving said sealing portion at a distance from one of the frame and the second door such that said sealing portion releases while remaining attached to one of said first door and frame; (d) moving said first door to the closed position; and (e) replacing the sealing portion to cover the gap; (f) cutting one of the magnetic portion and the sealing portion from at least one cutout portion adapted to receive at least one of a hinge, a handle, and a lock; (g) using the sealing portion as at least one of a thermal barrier, acoustic barrier, hermetic barrier, odor reducing barrier, contagion limiting barrier, and fire barrier; (h) covering at least a portion of the magnetically mountable seal with a vinyl layer; the first door comprises an inner surface, an opposite outer surface and an edge surface perpendicular to and positioned between the inner surface and the outer surface, the method further comprising the steps of (i) applying steps (a) and (b) such that the first surface is the inner surface of the first door, and (j) applying steps (a) and (b) such that the first surface is the outer surface of the first door; the frame comprises an inner surface, an opposite outer surface and an edge surface perpendicular to and positioned between the inner surface and the outer surface, and wherein the second surface is one of the inner surface of the frame and the outer surface of the frame, the method further comprising the steps of: (k) applying steps (a) and (b) such that the second surface is the inner surface of the frame; and (1) applying steps (a) and (b) such that the second surface is the outer surface of the frame.

Other features and features of the present application will be apparent to those commonly recognized in the relevant art for the purpose of describing the exemplary embodiments of the magnetically mountable seal disclosed herein below and in the accompanying drawings.

BRIEF DESCRIPTION OF THE DRAWINGS

Embodiments of the present application will be described, by way of example only, with reference to the drawings, wherein:

FIG. 18A is a front view of an illustration of an embodiment including a combination of the first and second exemplary embodiments of a magnetically mountable seal provided in accordance with the present application;

FIG. 18B is a top view of the door and the embodiment of FIG. 13A;

FIG. 18C is a right side view of the door and the embodiment of FIG. 13A;

The use of similar reference numbers in different figures serves to identify similar elements.

DETAILED DESCRIPTION OF THE DRAWINGS

Figures 1A, 1B, 1C:
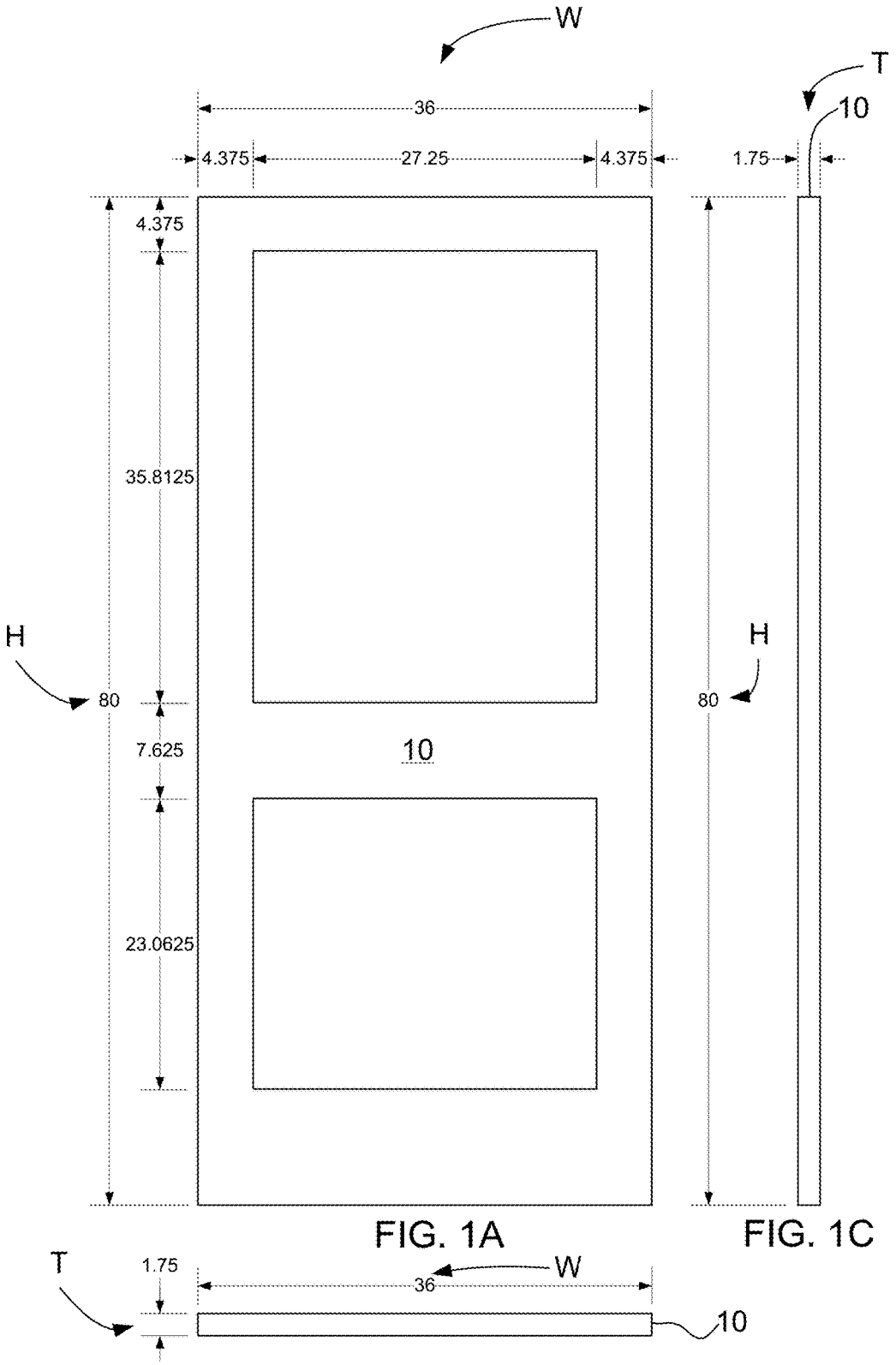
FIG. 1A is a front view of an illustration of a typical door.
FIG. 1B is a top view of the door of FIG. 1A.
FIG. 1C is a right side view of the door of FIG. 1A.

With reference to the drawings, FIGS. 1A-C illustrate a typical door. A door 10 has a width W, a height H, and a thickness T. As shown from the front in FIG. 1A, from the top in FIG. 1B, and from the side in FIG. 1C, door 10 measures W×H×T=36"×80"×1.75". These dimensions are for illustrative purposes only. A person ordinarily skilled in the relevant art will be able to adapt the techniques of the present application to any door, regardless of its dimensions. The door 10 can be used alone in a single associated frame, or with another door in a double associated frame. The present application uses by way of example a door 10 having a metal surface, e.g. of steel. The door 10 includes an inner surface, an opposite outer surface and an edge surface perpendicular to and positioned between the inner surface and the outer surface.

Figure 2:
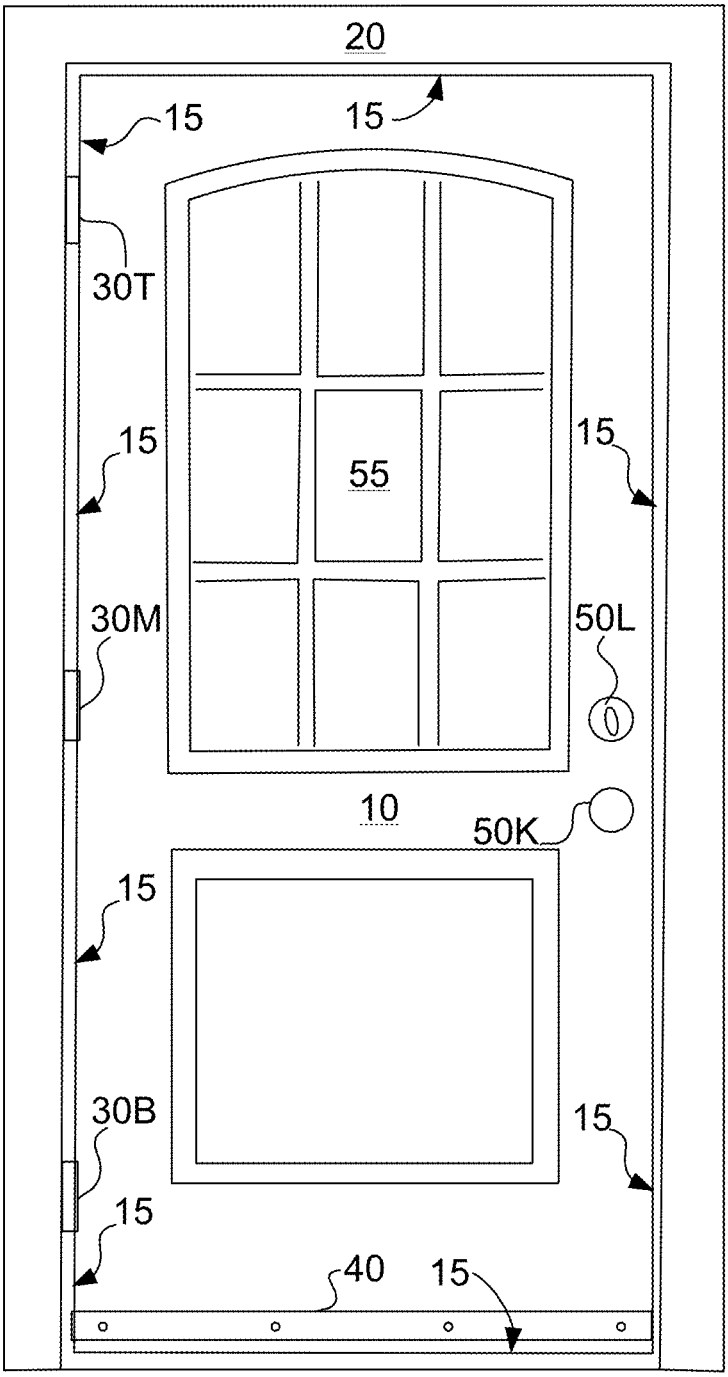
FIG. 2 is an illustration of a door mounted in its frame.

FIG. 2 is an illustration of a door mounted in its frame. The door 10 is retained in its frame 20 by three hinges 30T, 30M, and 30B located on the left side of the door. A gap 15 exists throughout the perimeter of the door 10 between the door 10 and its frame 20. A weatherstripping 40 is located at the bottom of the door 10. A lock 50L and a handle 50K are situated on the right side of the door 10 to allow a person to manipulate the door 10 to open and close it by turning it on its hinges 30T, 30M, and 30B. The door 10 is in the closed position. The visible surface of the door 10 which is substantially parallel to the surface of the frame 20 is the inner surface of the door.

Figure 3:
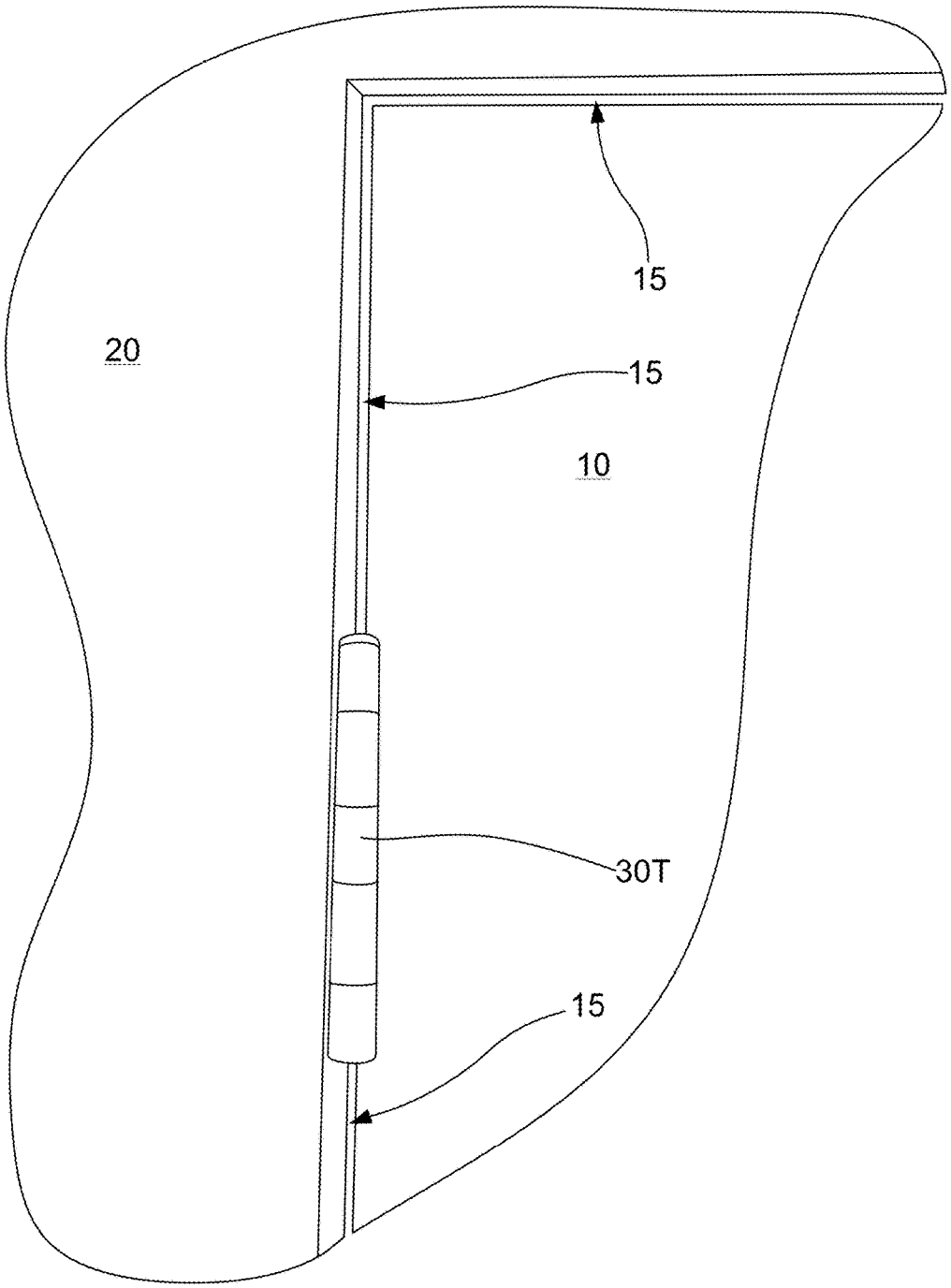
FIG. 3 is a perspective view of a portion of the gap between the door of FIG. 2 and its frame.

FIG. 3 is a perspective view of a portion of the gap between the door of FIG. 2 and its frame. The upper left corner of the door 10 is illustrated and shows the gap 15 between the door 10 and its frame when the hinge 30T is in the closed position.

Figure 4A:
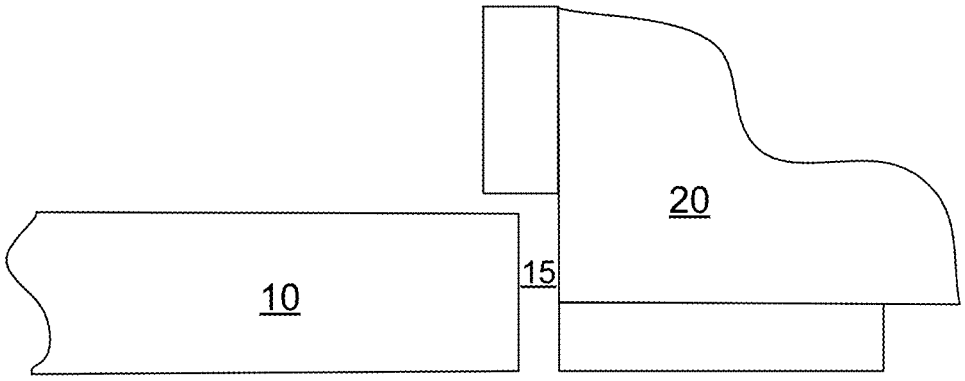
FIG. 4A is a cross-sectional view of the gap between the door of FIG. 2 and its frame, when the door is in a closed position.
Figure 4B:
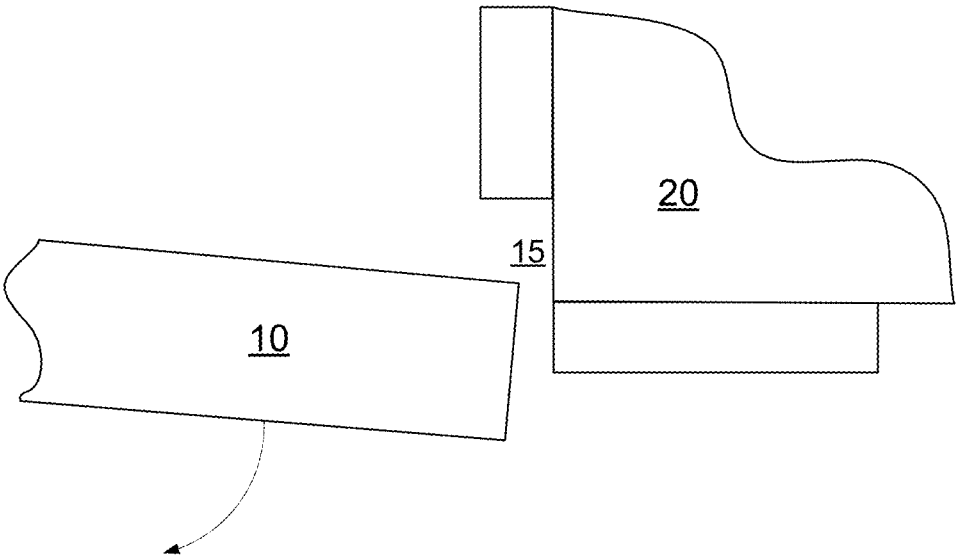
FIG. 4B is a cross-sectional view of the gap between the door of FIG. 2 and its frame, when the door is in an open position.

FIGS. 4A-B are cross-sectional views of the gap between the door of FIG. 2 and its frame. In FIG. 4A, the gap 15 is between the frame 20 and the door 10, which is closed. In FIG. 4B, the gap 15 is between the frame 20 and the door 10, which is open.

Figure 5A:
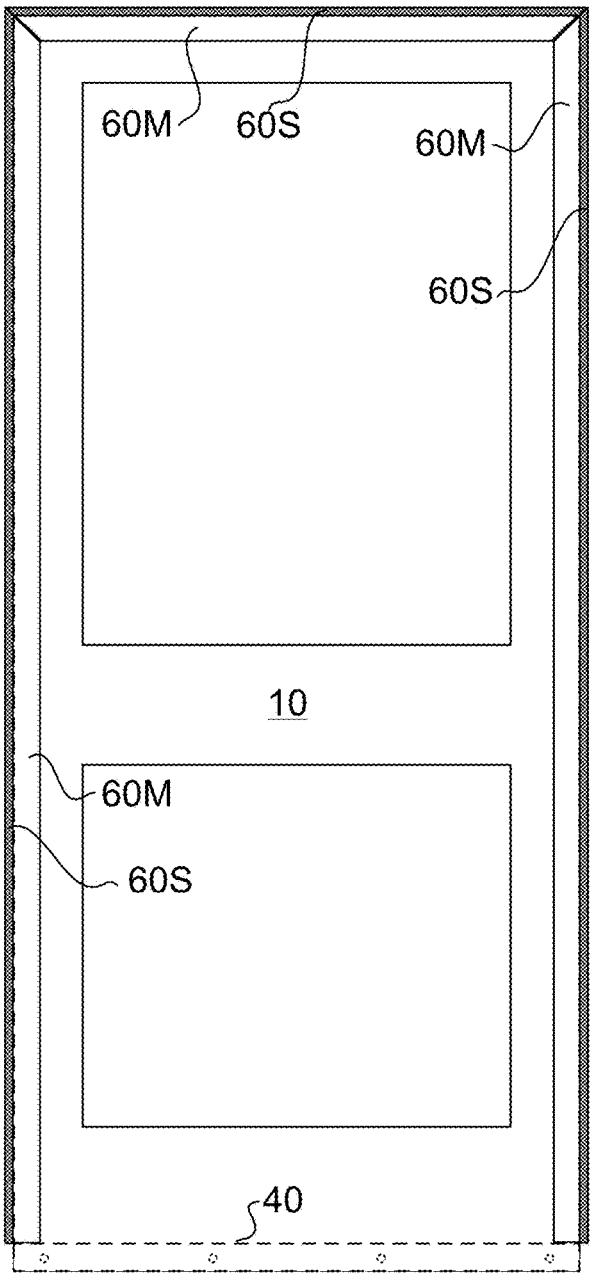
FIG. 5A is a front view of an illustration of a door including a first exemplary embodiment of a magnetically mountable seal provided in accordance with the present application.
Figure 5C:
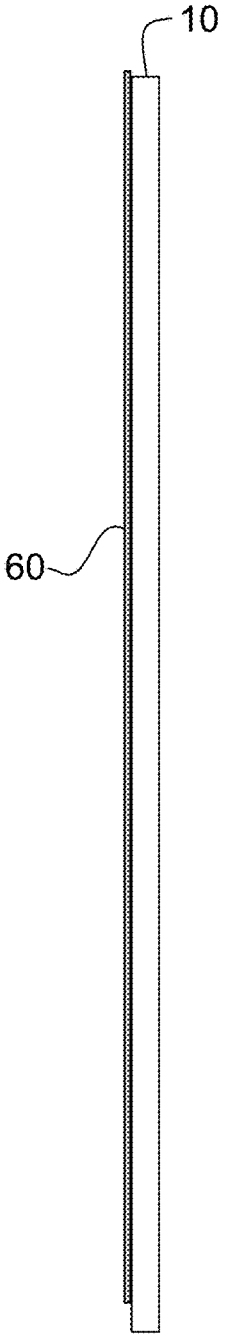
FIG. 5C is a right side view of the door and first exemplary embodiment of FIG. 5A.
Figure 5B:
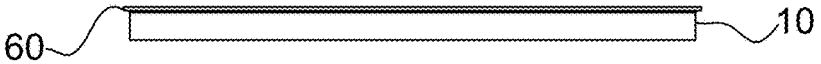
FIG. 5B is a top view of the door and first exemplary embodiment of FIG. 5A.

FIGS. 5A-C are illustrations of a door including a first exemplary embodiment of a magnetically mountable seal provided in accordance with the present application. As shown from the front in FIG. 1A, from the top in FIG. 1B, and from the side in FIG. 1C, the door 10 has a magnetically mountable seal 60 on its inner face. The magnetically mountable seal 60 includes a magnetic portion 60M and a sealing portion 60S. Advantageously, the sealing portion 60S is located in perimeter of the door 10 and will therefore serve to seal the gap between the door 10 and its associated frame and the magnetic portion 60M is located on the metal surface of the door 10 and fixes the sealing portion 60S in perimeter of the door 10. There is a weatherstripping 40 at the bottom of the door, and therefore in this example, the magnetically mountable seal does not extend over the bottom of the door.

Figure 6:
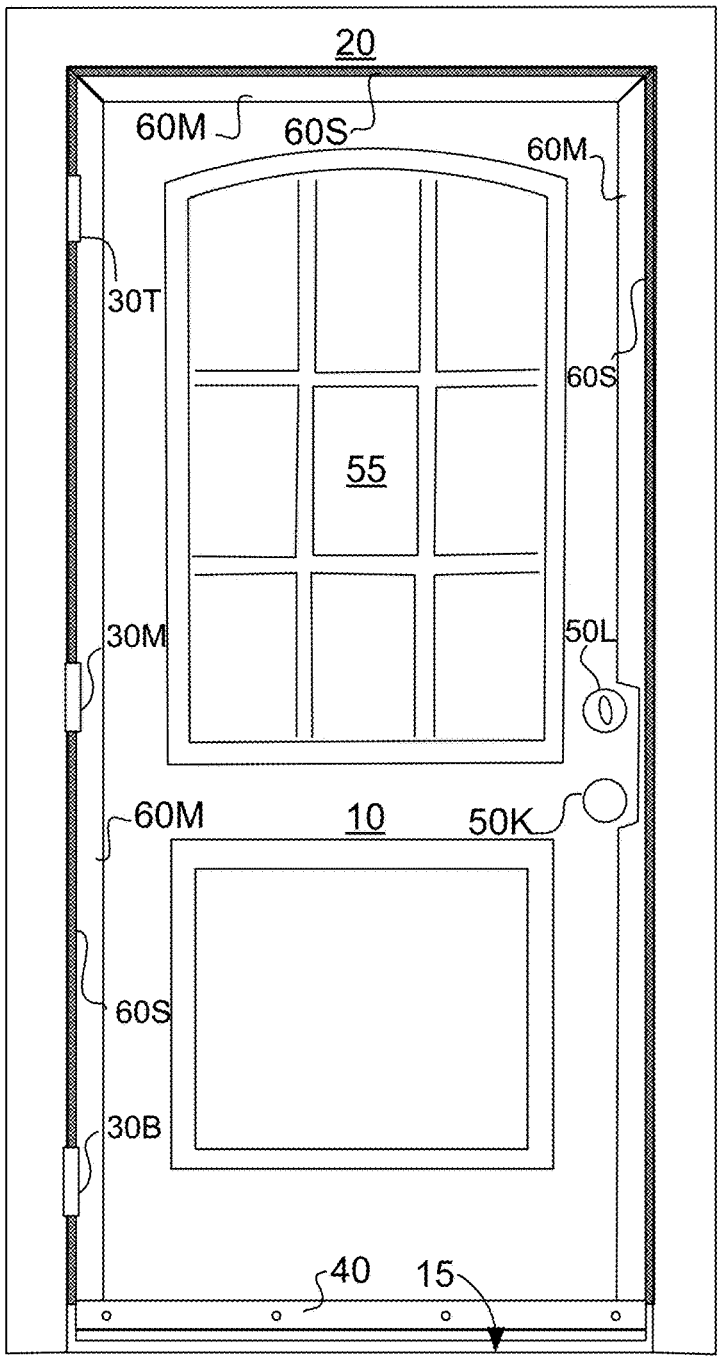
FIG. 6 is an illustration of the door of FIG. 2 on which is mounted the first embodiment of the magnetically mountable seal of FIGS. 5A-C.

FIG. 6 is an illustration of the door in FIG. 2 on which is mounted the first embodiment of the magnetically mountable seal of FIGS. 5A-C. The door 10 is retained in its frame 20 by three hinges 30T, 30M, and 30B located on the left side of the door. The seal 60 is cut at these locations to allow the hinges to rotate without obstruction. Advantageously, the gap 15 which exists throughout the perimeter of the door 10 between the door 10 and its frame 20 is substantially covered by the sealing portion 60S of the magnetically mountable seal 60. A weatherstripping 40 is located at the bottom of the door 10, and at this point the gap 15 is not covered in this example. A 50L lock and a 50K handle are located on the left side of the door 10 to allow a person to manipulate the door 10 to open and close it by turning it on its hinges 30T, 30M, and 30B. A window 55 is located in the top part of the door 10. The door 10 is in the closed position. The visible surface of the door 10 which is substantially parallel to the surface of the frame 20 is the inner surface of the door.

Figure 7:
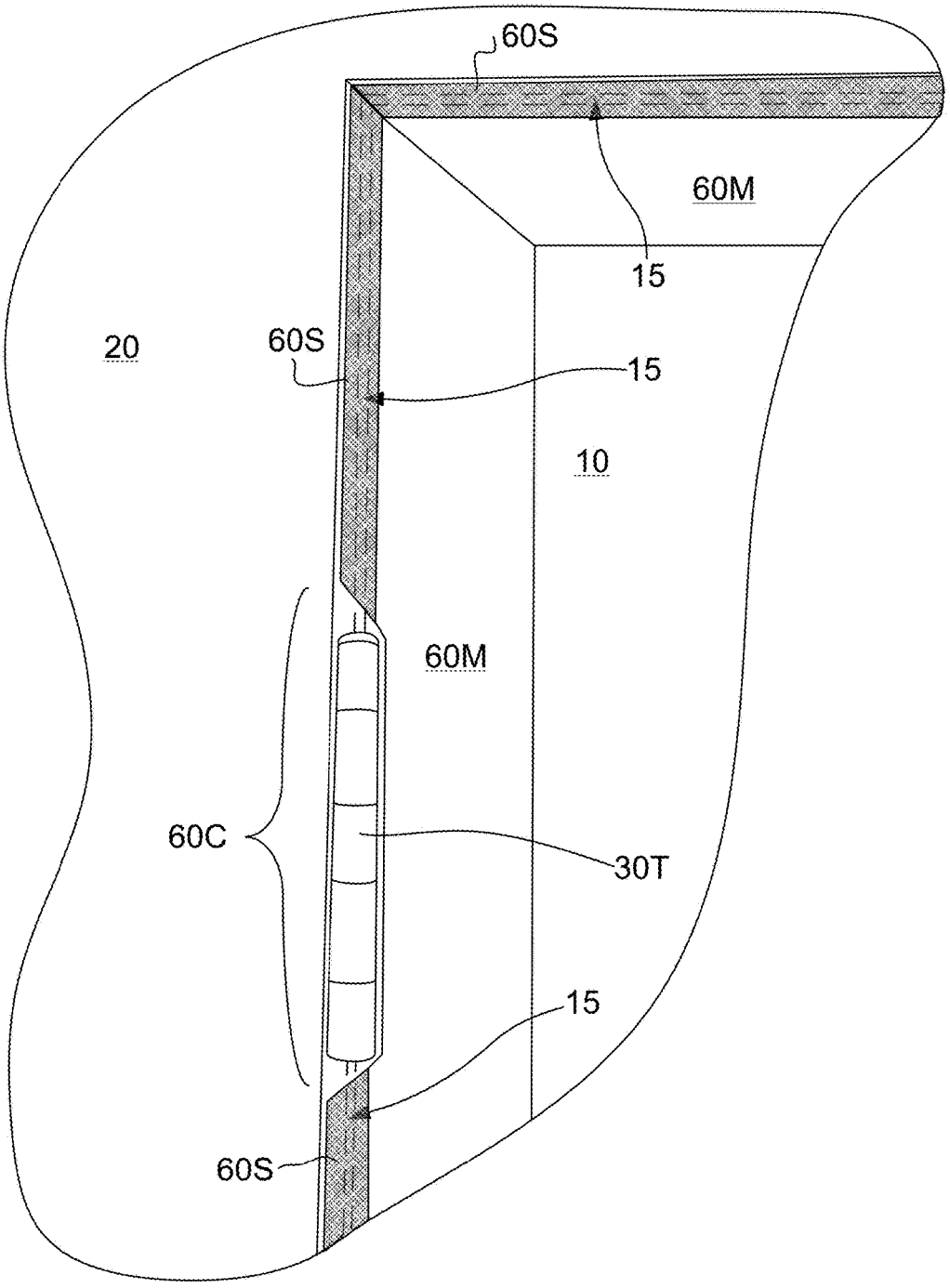
FIG. 7 is a perspective view of a first portion of the magnetically mountable seal of FIGS. 5A-C operating on the gap between the door of FIGS. 5A-C and its frame.

FIG. 7 is a perspective view of a first portion of the magnetically mountable seal of FIGS. 5A-C operating on the gap between the door of FIGS. 5A-C and its frame. More detail can be seen of the cut portion 60C of the magnetically mountable seal which advantageously allows the hinge 30T to operate in substantially the same way as if the magnetically mountable seal was not fixed to the door 10. It can be seen, in greater detail, how the magnetic portion 60M fixes the sealing portion 60S in relation to the perimeter of the door 10 to cover the gap 15. The magnetically mountable seal is provided in several pieces which are beveled to an angle of about 45 degrees, which has the advantage of preserving the aesthetics of the door 10.

Figure 8:
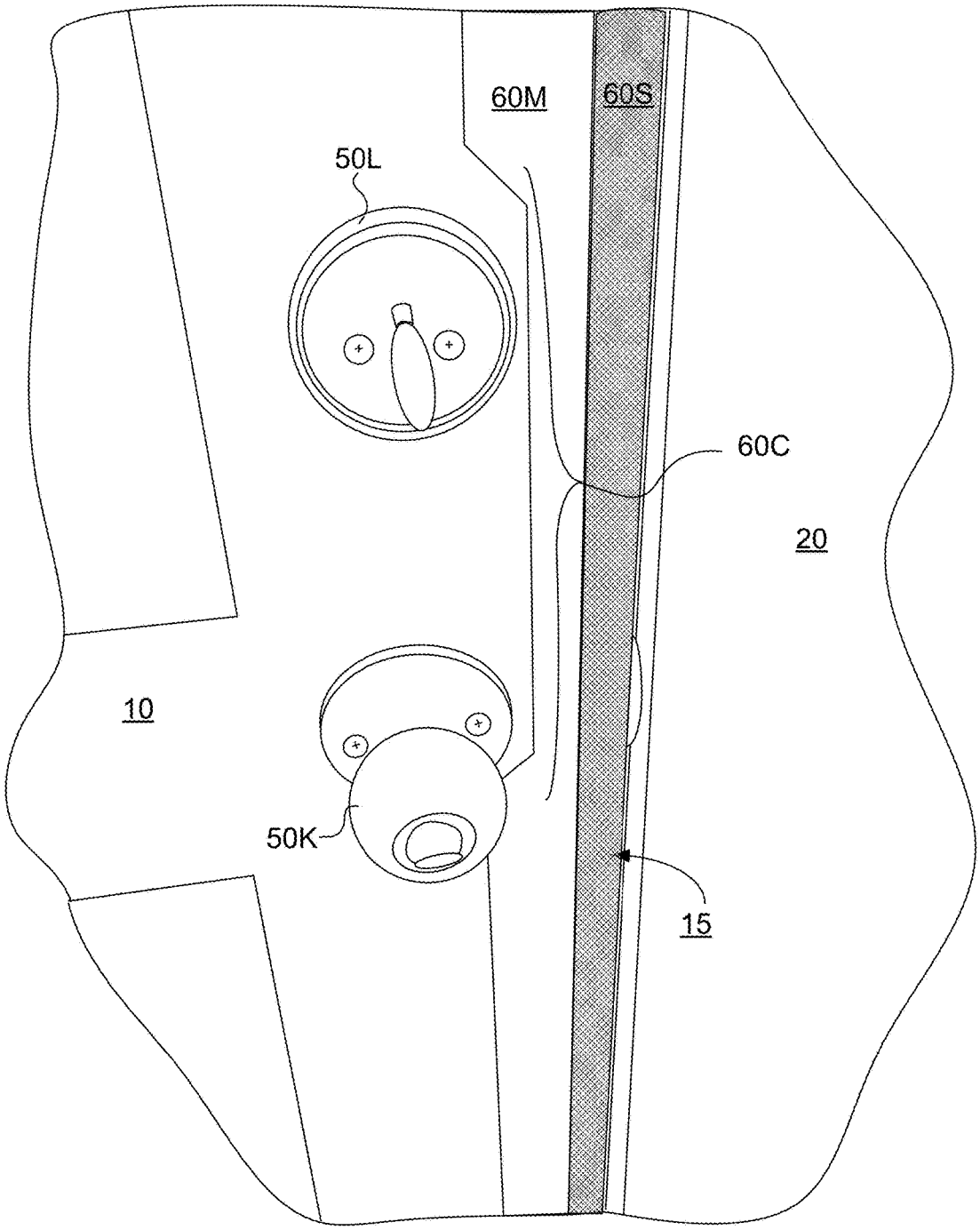
FIG. 8 is a perspective view of a second portion of the magnetically mountable seal of FIGS. 5A-C operating on the gap between the door of FIGS. 5A-C and its frame.

FIG. 8 is a perspective view of a second portion of the magnetically mountable seal of FIGS. 5A-C operating on the gap between the door of FIGS. 5A-C and its frame. More detail can be seen of the cut portion 60C of the seal which advantageously allows the lock 50L and the handle 50K to operate in substantially the same way as if the magnetically mountable seal was not fixed to the door 10. In greater detail, it is seen how the magnetic portion 60M fixes the sealing portion 60S in relation to the perimeter of the door 10 to cover the gap 15.

Figure 9A:
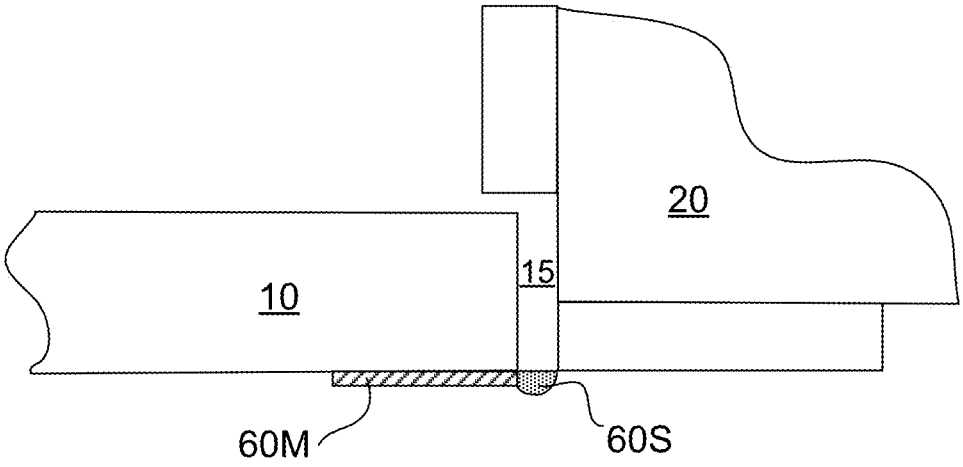
FIG. 9A is a cross-sectional view of the magnetically mountable seal of FIGS. 5A-C operating on the gap between the door of FIGS. 5A-C and its frame, when the door is in an open position.
Figure 9B:
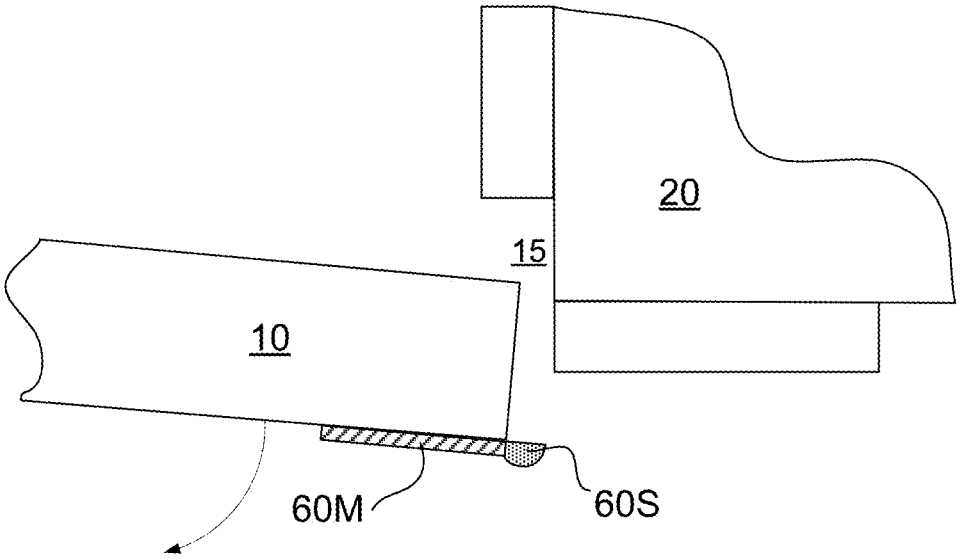
FIG. 9B is a cross-sectional view of the magnetically mountable seal of FIGS. 5A-C operating on the gap between the door of FIGS. 5A-C and its frame when the door is in a closed position.

FIGS. 9A-B are cross-sectional views of the magnetically mountable seal of FIG. 5 operating on the gap between the door of FIG. 5 and its frame. In FIG. 9A, the gap 15 is between the frame 20 and the door 10, which is closed. In FIG. 9B, the gap 15 is between the frame 20 and the door 10, which is open. Advantageously when the door 10 is closed the sealing portion 60S is secured to the door 10 by the magnetic portion 60M so that the gap 15 is covered by the sealing portion 60S and when the door 10 is opened, the door and the frame 20 operate substantially as if the magnetically mountable seal 60 is not present.

Figure 10B:
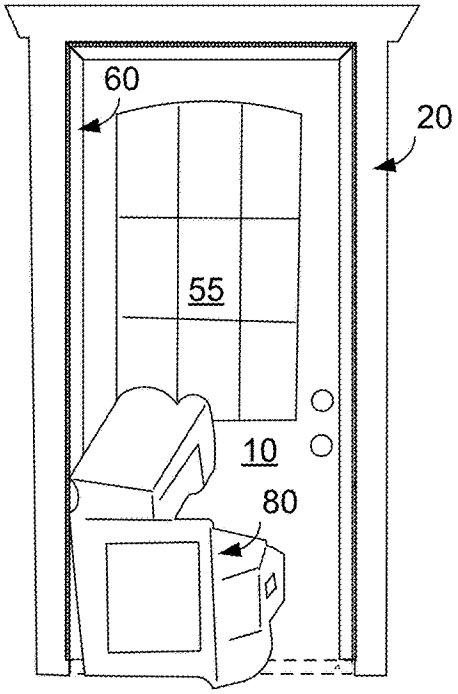
FIG. 10B illustrates the equipment and the controlled environment used to capture the infrared images in the present application at a the door of FIG. 6.
Figure 10A:
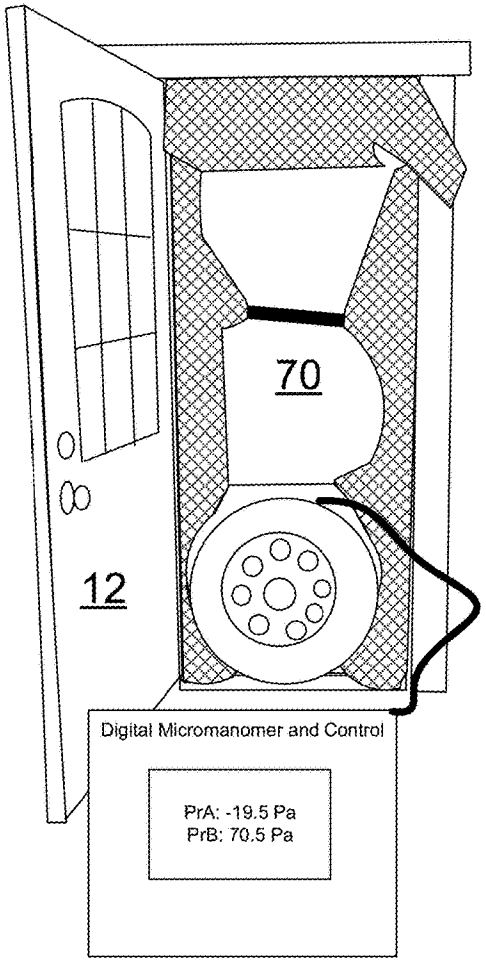
FIG. 10A illustrates the equipment and the controlled environment used to capture the infrared images in the present application at a door.

FIGS. 10A-B illustrate the equipment and the controlled environment used to capture the infrared images in the present application. FIG. 10A illustrates the equipment used at a door to create a difference in atmospheric pressure between the interior of a house and its exterior. The door 12 is kept open, while a sealed partition 70 provided with a device for creating a pressure difference is placed in its frame. FIG. 10B illustrates the infrared image taken at the second door 10 using an infrared camera 80. A window 55 is located in the top part of the door 10. The pressure difference causes fresh air to enter through the gap between the door 10 and its frame 20. The effectiveness of the magnetically mountable seal 60 can thus be verified by comparing the infrared images thus obtained with and without a magnetically mountable seal fixed on the door 10.

Figure 11:
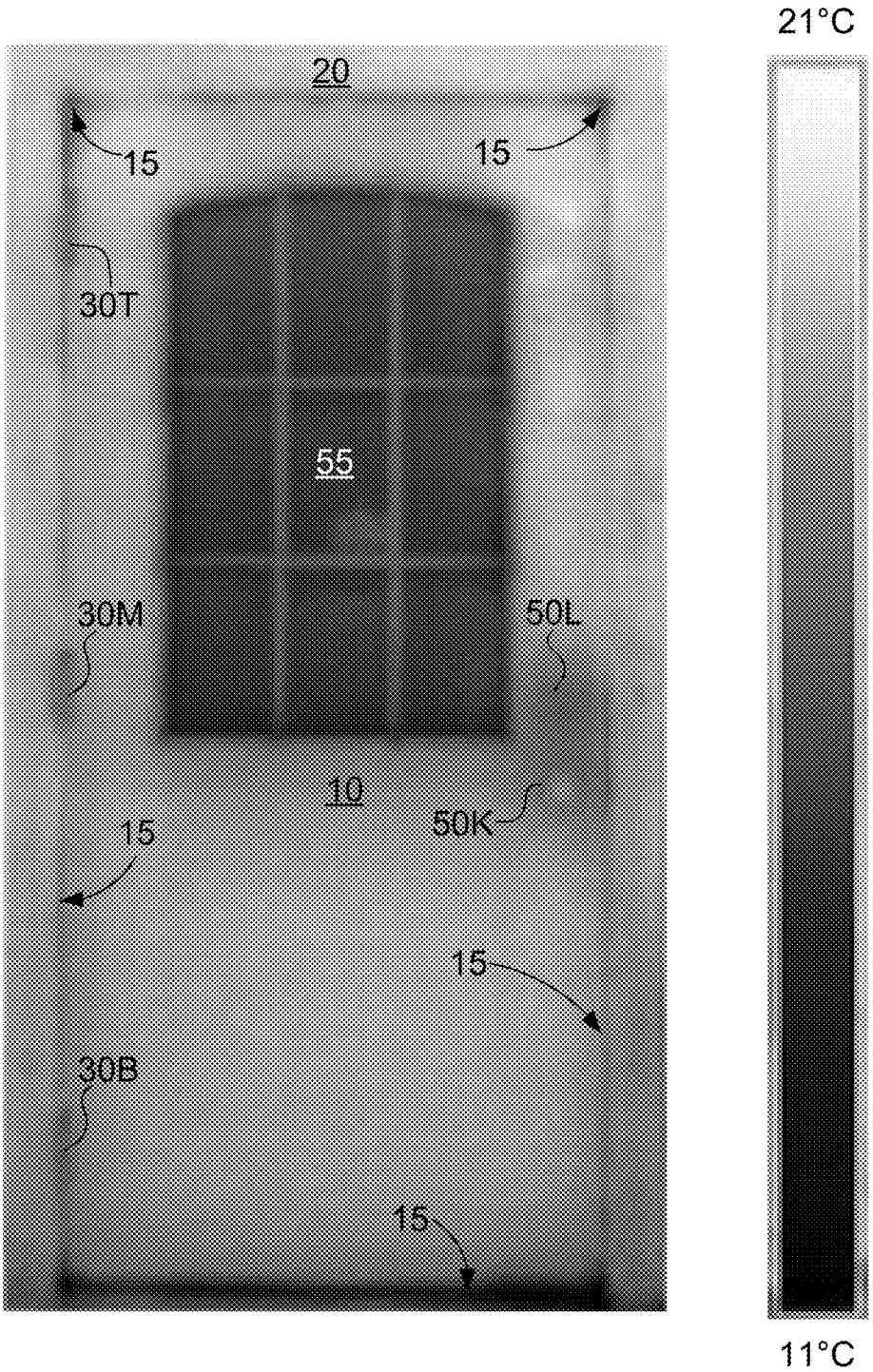
FIG. 11 is an infrared image of the frame, of the door, and the magnetically mountable seal of FIGS. 5A-C.

FIG. 11 is an infrared image of the frame, of the door, and the magnetically mountable seal of FIGS. 5A-C. The image uses shades of gray to show the temperature between 11° C. (black) and 22° C. (white). The frame 20 and the door 10, as well as the hinges 30T, 30M and 30B, the lock 50L, the handle 50K, can be seen. A window 55 is located in the top part of the door 10. The gap 15 between the door 10 and the frame 20 is barely visible on the majority of the perimeter of the door 10 by virtue of the presence of the magnetically mountable seal (invisible in the infrared, but fixed on the door).

Figure 12:
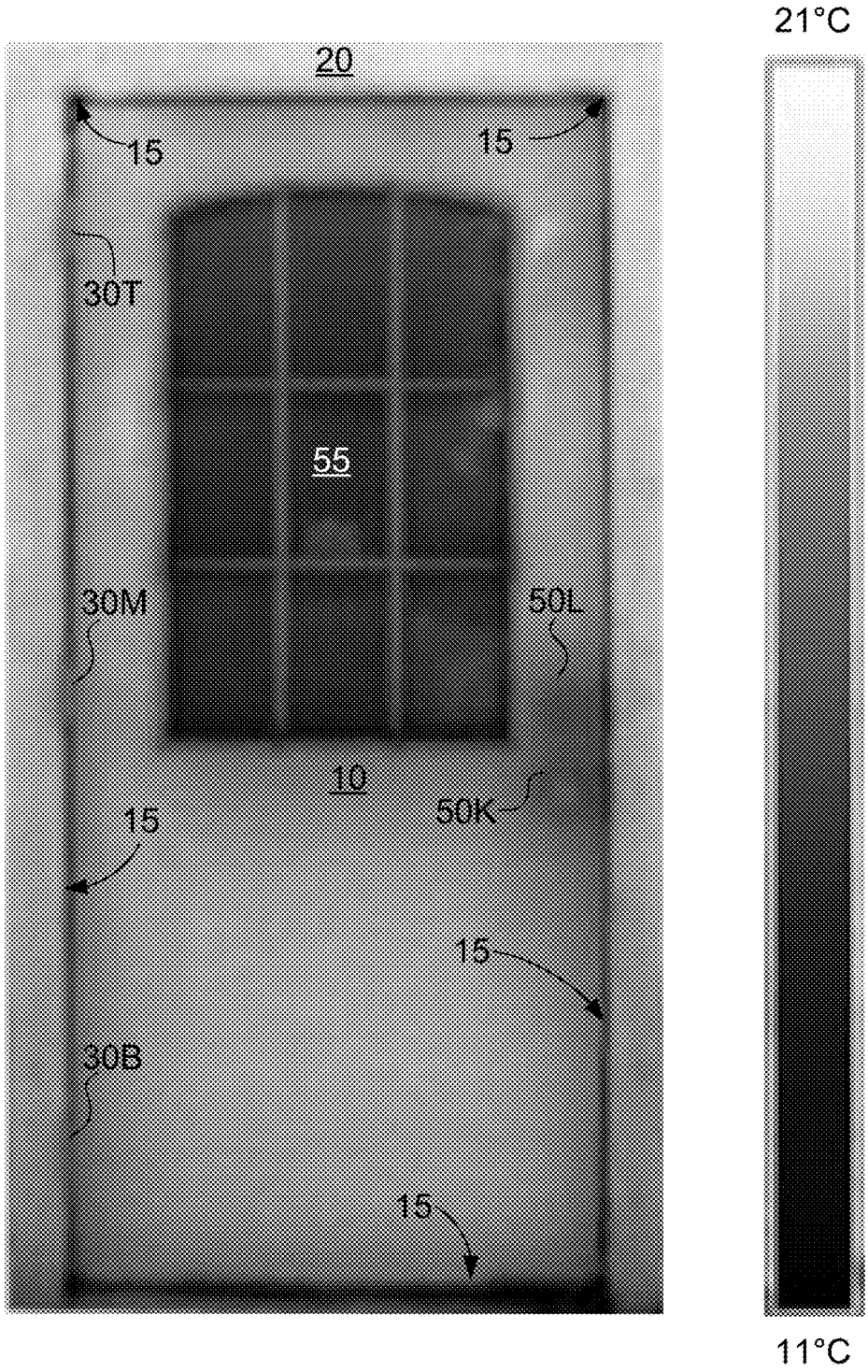
FIG. 12 is an infrared image of the frame and the door of FIG. 2.

FIG. 12 is an infrared image of the frame and the door of FIG. 2. The image uses shades of gray to illustrate the temperature between 11° C. (black) and 22° C. (white). The frame 20 and the door 10, as well as the hinges 30T, 30M and 30B, the lock 50L, the handle 50K, can be seen. A window 55 is located in the top part of the door 10. The gap 15 between the door 10 and the frame 20 is clearly visible on the majority of the perimeter of the door 10 due to the absence of the magnetically mountable seal.

By comparing the infrared images before (FIG. 12) and after (FIG. 11) using the embodiment of the magnetically mountable seal 60, there is a clear improvement in the energy efficiency around the gap 15, which will have the effect of reducing energy consumption, advantageously due to the effect of the sealing portion 60S which provides insulation, which is absent in the prior solutions. The controlled environment illustrated in FIG. 10 and used to obtain the images before (FIG. 12) and after (FIG. 11) is very demanding, especially since the embodiment of the magnetically mountable seal 60 used to obtain the image after (FIG. 11) was handcrafted. The inventor therefore envisages even more advantageous results in energy efficiency with an industrial manufacture of the embodiments of the magnetically mountable seal 60. In addition, by comparing the visible (FIG. 6) and infrared (FIG. 11), both including embodiments of the magnetically mountable seal 60, it is found that the magnetic portion 60M is distinguished from the door 10 in the image of FIG. 6, but the temperature of the magnetic portion 60M merges with that of the door 10 in FIG. 11, which implies that a magnetic tape alone does not offer insulating properties comparable to those obtained by the sealing portion 60S.

Figure 13A:
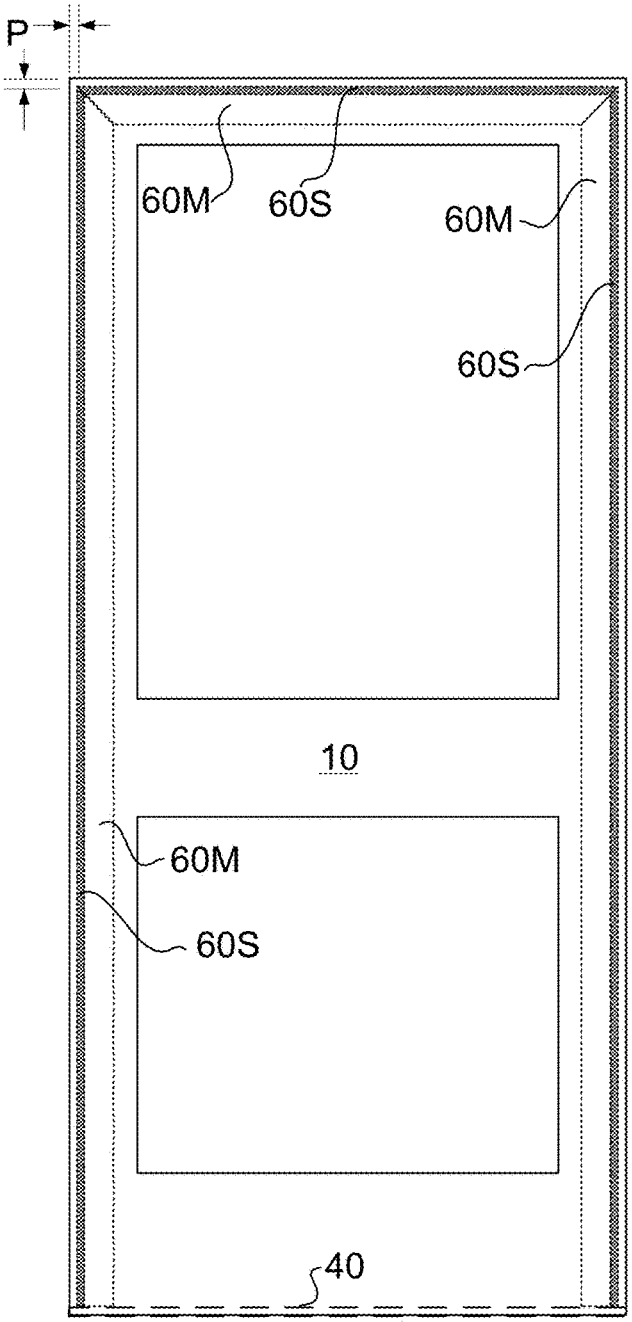
FIG. 13A is front view of an illustration of a second exemplary embodiment of a magnetically mountable seal provided in accordance with the present application.
Figure 13C:
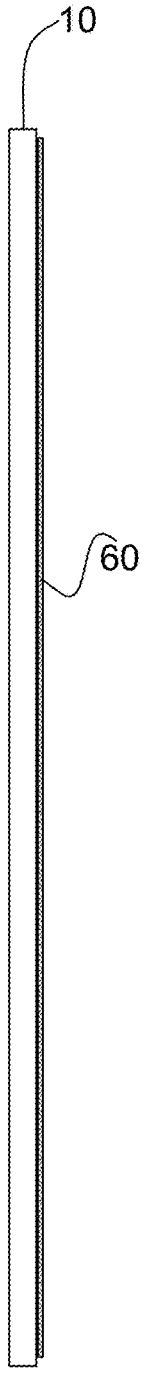
FIG. 13C is a right side view of the door and second exemplary embodiment of FIG. 13A.
Figure 13B:
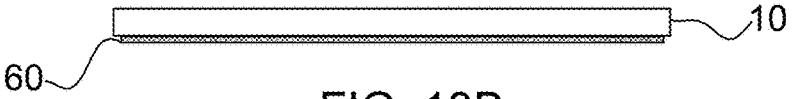
FIG. 13B is a top view of the door and second exemplary embodiment of FIG. 13A.

FIGS. 13A-C illustrate a second exemplary embodiment of a magnetically mountable seal provided in accordance with the present application. As shown in FIG. 13A, from the top in FIG. 13B, and from the side in FIG. 13C, the door 10 has a magnetically mountable seal 60 on its outer face. The magnetically mountable seal comprises a magnetic portion 60M and a sealing portion 60S. Advantageously, the sealing portion 60S is located at a distance P from the perimeter of the door 10 and will therefore serve to seal the gap between the door 10 and its associated frame and the magnetic portion 60M is located on the metal surface of the door 10 and fixes the sealing portion 60S at a distance P from the perimeter of the door 10. There is a weatherstripping 40 at the bottom of the door, and therefore in this example the magnetically mountable seal does not extend to the bottom of the door.

Figure 14:
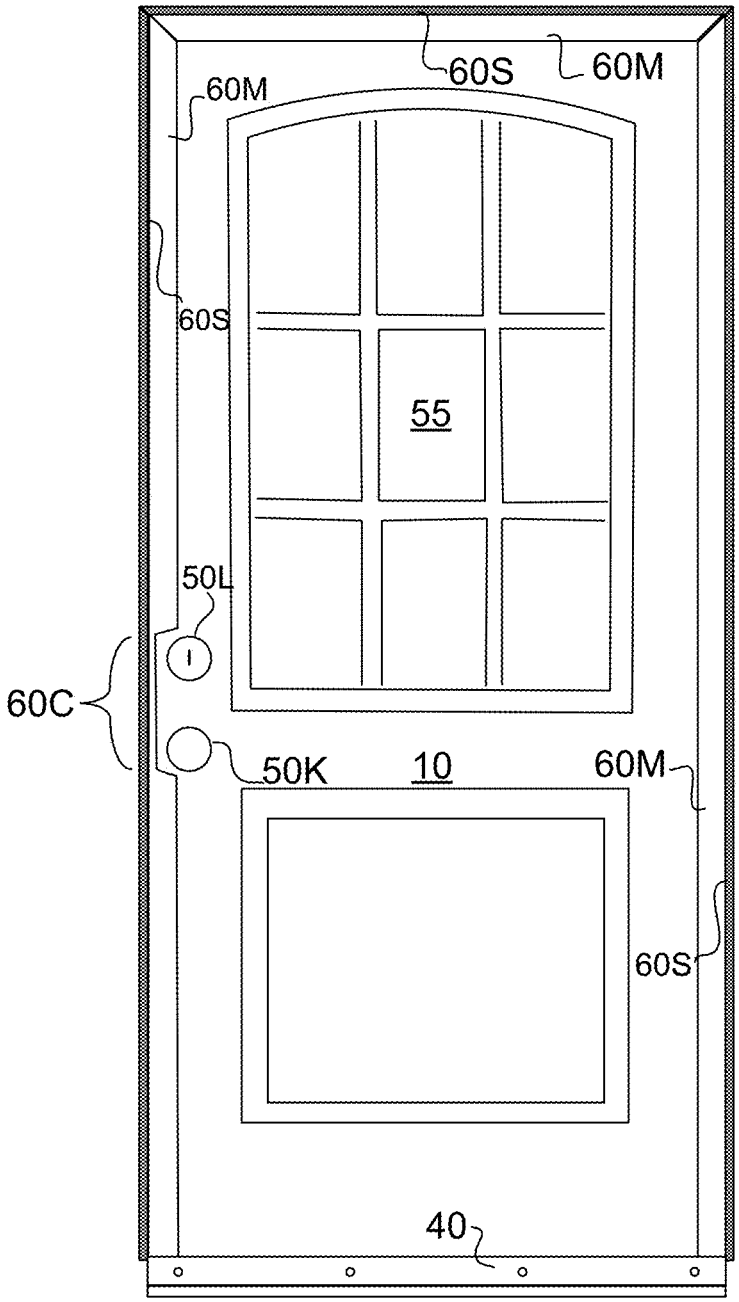
FIG. 14 is an illustration of the exterior surface of the door of FIGS. 13A-C to which is mounted the second exemplary embodiment of the magnetically mountable seal of FIGS. 13A-C.

FIG. 14 is an illustration of the exterior surface of the door of FIGS. 13A-C to which is mounted the second exemplary embodiment of the magnetically mountable seal of FIGS. 13A-C. The door is open, inwards. A window 55 is located in the top part of the door 10, where one can see the inside. The magnetically mountable seal comprises a magnetic portion 60M and a sealing portion 60S. The cut portion 60C of the magnetically mountable seal advantageously allows the lock 50L and the handle 50K to operate in substantially the same way as if the magnetically mountable seal was not fixed to the door 10. Advantageously, the sealing portion 60S is located at a distance P from the perimeter of the door 10 and will therefore serve to seal the gap between the door 10 and its associated frame and the magnetic portion 60M is located on the metal surface of the door 10 and fixes the sealing portion 60S to the perimeter of the door 10. There is a weatherstripping 40 at the bottom of the door, and therefore in this example, the seal with magnetic fixing does not extend on the bottom of the door.

Figure 15:
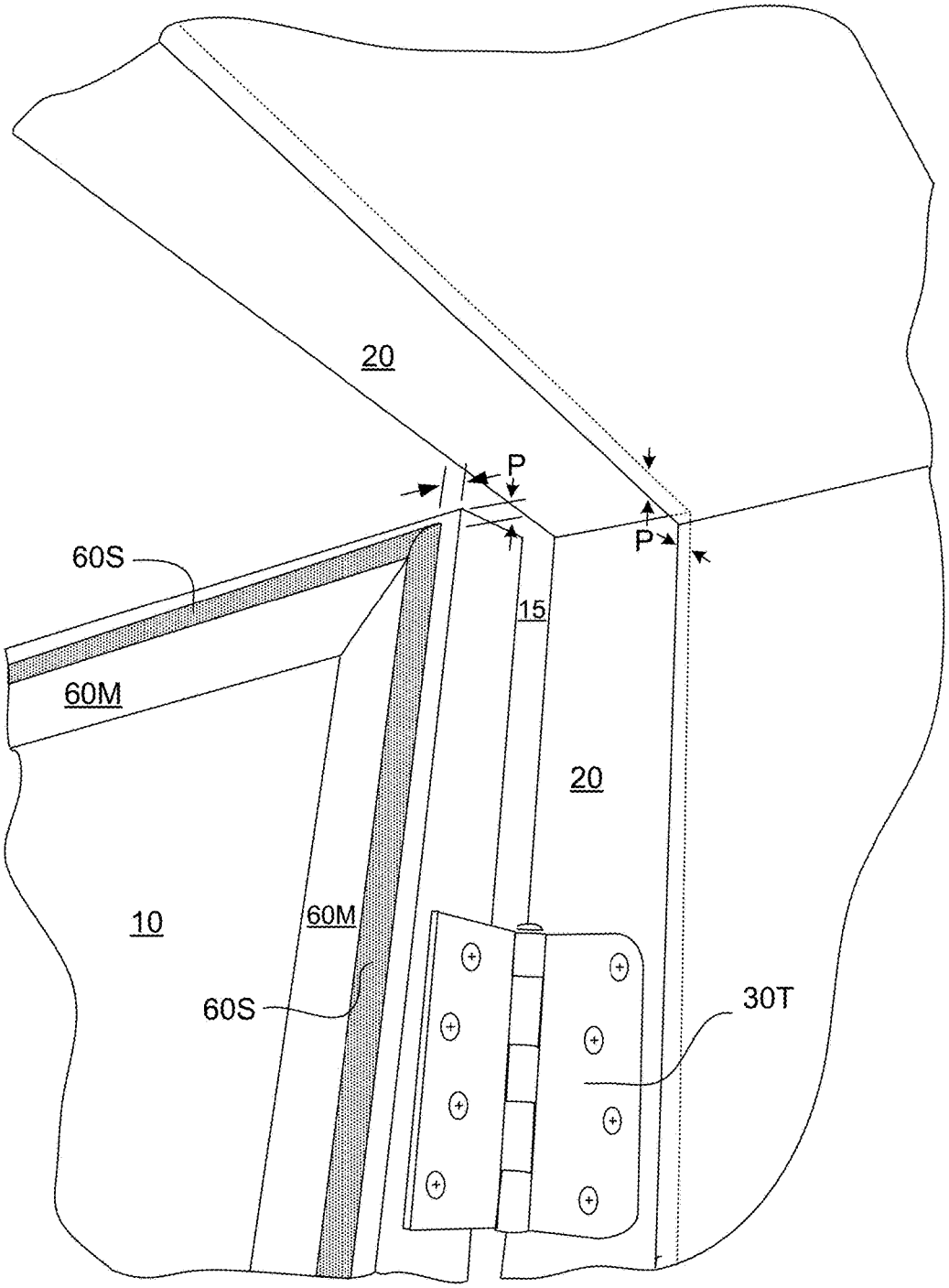
FIG. 15 is a perspective view of a portion of the magnetically mountable seal of FIGS. 13A-C operating on the gap between the door of FIGS. 13A-C and its frame.

FIG. 15 is a perspective view of a portion of the magnetically mountable seal of FIGS. 13A-C operating on the gap between the door of FIGS. 13A-C and its frame. The door is open, inwards. The magnetically mountable seal includes a magnetic portion 60M and a sealing portion 60S. Advantageously, the sealing portion 60S is located at a distance P from the perimeter of the door 10 and will therefore serve to seal the gap 15 between the door 10 and its associated frame 20 and the magnetic portion 60M is located on the metal surface of the door 10 and fixes the sealing portion 60S at a perimeter distance P from the door 10. The same distance P is again found in the frame 20 so that when the door 10 is closed the sealing portion 60S rests on the frame 20 to cover the gap 15. The frame 20 includes an inner surface, an opposite outer surface and an edge surface perpendicular to and positioned between the inner surface and the outer surface.

Figure 16A:
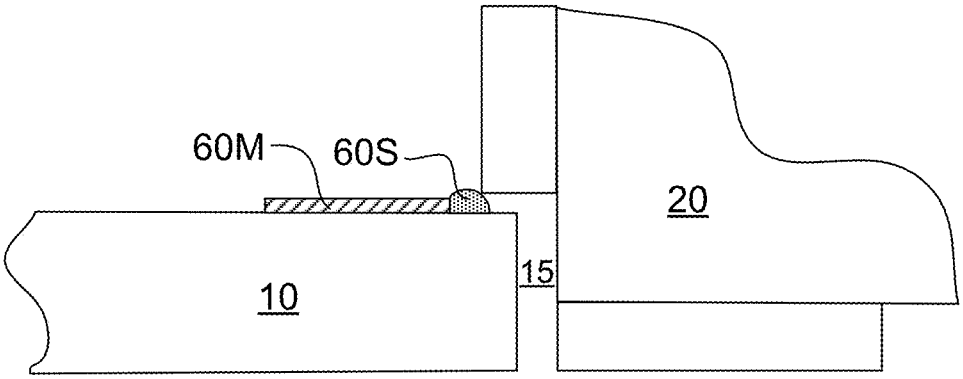
FIG. 16A is a cross-sectional view of the magnetically mountable seal of FIGS. 13A-C operating on the gap between the door of FIGS. 13A-C and its frame, when the door is in a closed position.
Figure 16B:
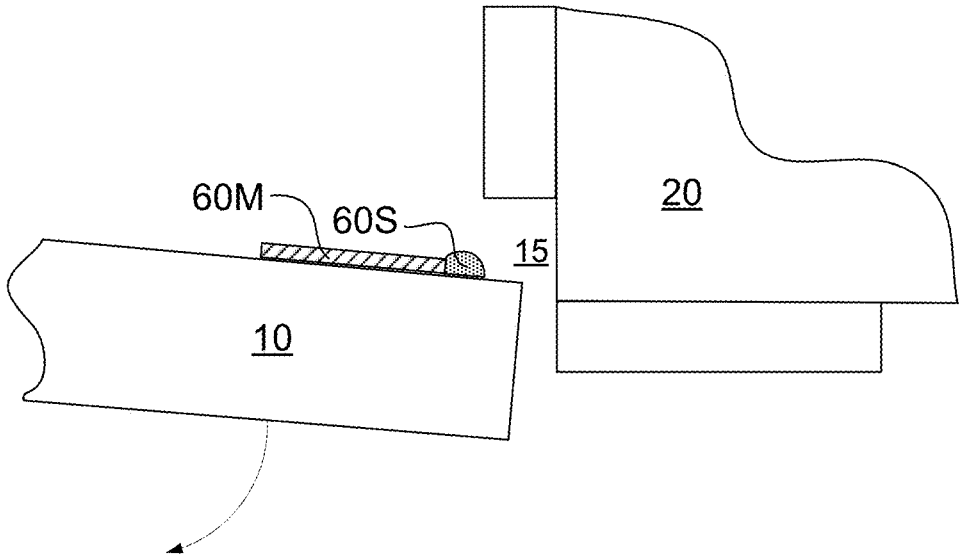
FIG. 16B is a cross-sectional view of the magnetically mountable seal of FIGS. 13A-C operating on the gap between the door of FIGS. 13A-C and its frame, when the door is in an open position.

FIG. 16A-B are cross-sectional views of the magnetically mountable seal of FIGS. 13A-C operating on the gap between the door of FIGS. 13A-C and its frame. In FIG. 16A, the gap 15 is between the frame 20 and the door 10, which is closed. In FIG. 16B, the gap 15 is between the frame 20 and the door 10, which is open. Advantageously when the door 10 is closed the sealing portion 60S is secured to the door 10 by the magnetic portion 60M so that the gap 15 is covered by the sealing portion 60S and when the door 10 is opened, the door and the frame 20 operate substantially as if the magnetically mountable seal 60 is not present.

Figure 17:
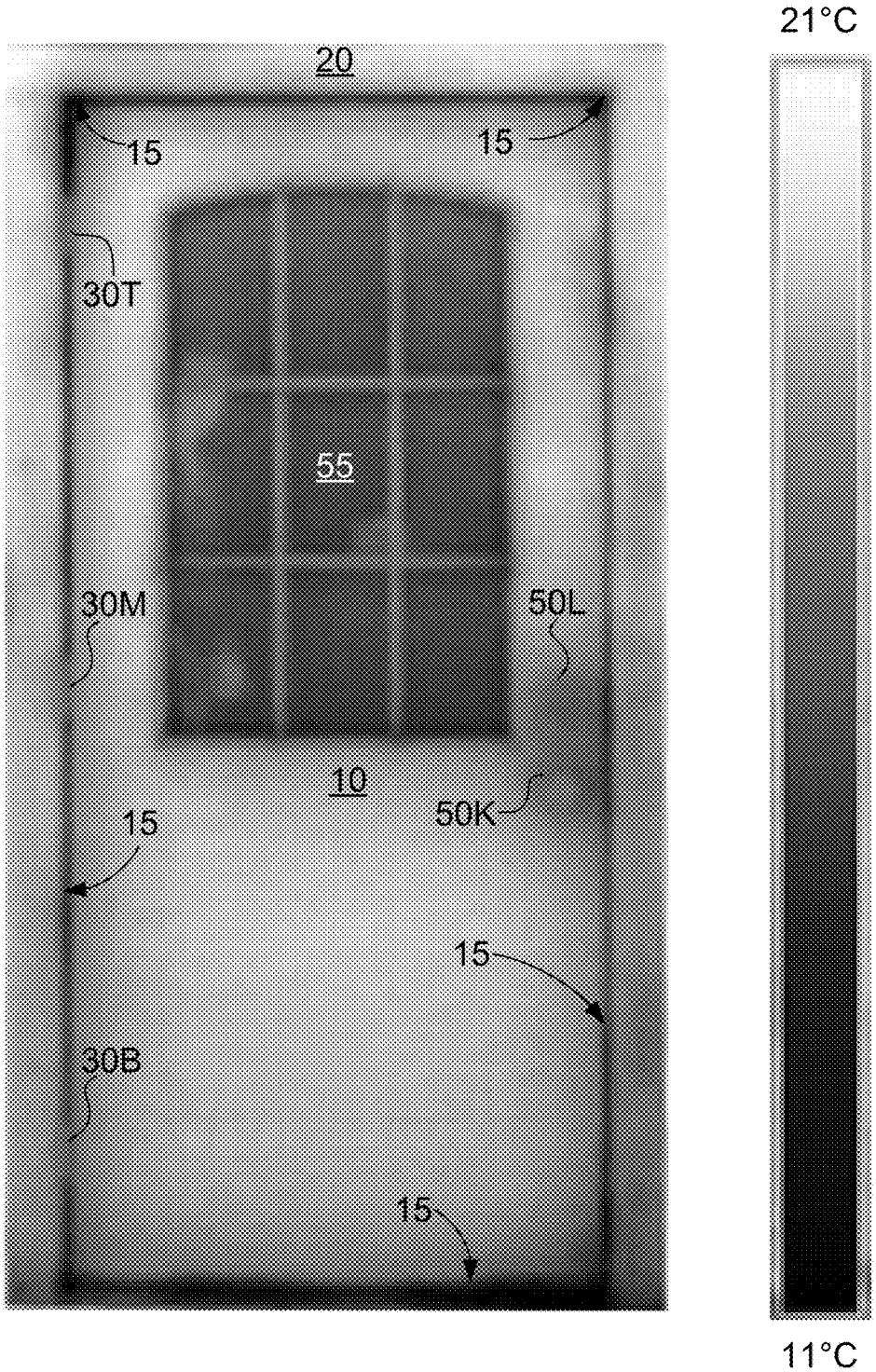
FIG. 17 is an infrared image of the frame, the door and the magnetically mountable seal of FIGS. 13A-C.

FIG. 17 is an infrared image of the frame, the door, and the seal of FIGS. 13A-C. The image uses shades of gray to illustrate the temperature between 11° C. (black) and 22° C. (white). The frame 20 and the door 10, as well as the hinges 30T, 30M and 30B, the lock 50L, the handle 50K, can be seen. A window 55 is located in the top part of the door 10. The gap 15 between the door 10 and the frame 20 is somewhat less visible on the majority of the perimeter of the door 10 due to the presence of the magnetically mountable seal mounted on the other side (outside) of the door.

FIG. 18A-C illustrate an embodiment including a combination of the first and second exemplary embodiments of a magnetically mountable seal provided in accordance with the present application. As shown from the front in FIG. 13A, from the top in FIG. 13B, and from the side in FIG. 13C, the door 10 has a magnetically mountable seal 60*e* on its outer face and a magnetically mountable seal 60*i* on its inner face. The magnetically mountable seal 60*i*, 60*e* includes a magnetic portion 60Mi, 60Me and a sealing portion 60Si, 60Se. Advantageously, the exterior sealing portion 60Se is located at a distance P from the outer perimeter of the door 10, and will therefore serve to seal the gap between the door 10 and its associated frame on the outside and the exterior magnetic portion 60Me is located on the outer metal surface of the door 10 and fixes the exterior sealing portion 60Se at a distance P from the outer perimeter of the door 10. Advantageously, the sealing portion 60Si inside is in the inner perimeter of the door 10 and will serve to seal the gap between the door 10 and its associated frame in the interior and the magnetic portion 60Mi is located on the inner metal surface of the door 10 and fixes the sealing portion 60Si inside the inner perimeter of the door 10. There is a weatherstrip 40*e,* 40*i* at the bottom of the door, and therefore in this example, the magnetically mountable seal 60*e,* 60*i* does not extend over the bottom of the door.

Figure 19A:
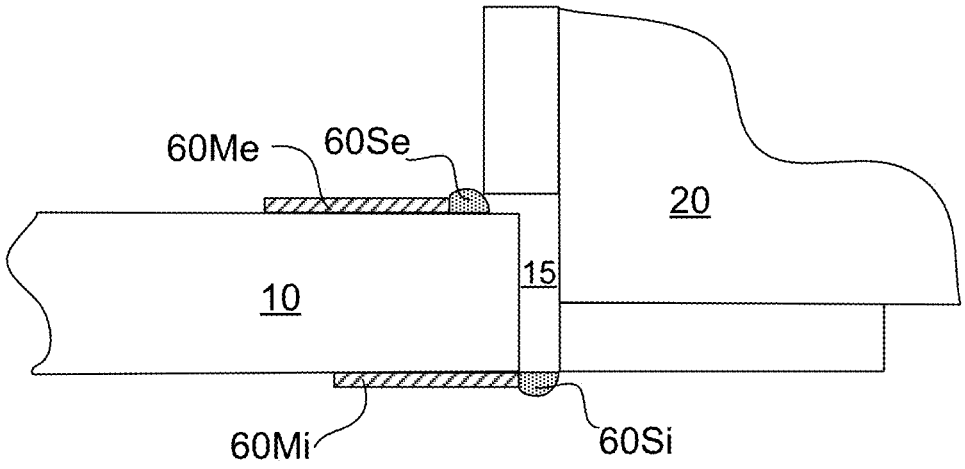
FIG. 19A is a sectional view of the magnetically mountable seal of FIGS. 18A-C operating on the gap between the door of FIGS. 18A-C and its frame, when the door is in a closed position.
Figure 19B:
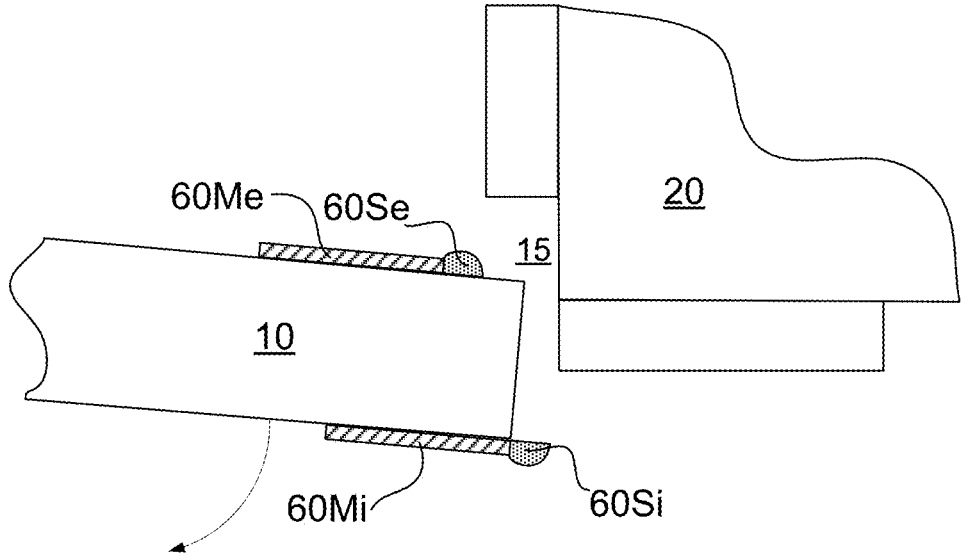
FIG. 19B is a sectional view of the magnetically mountable seal of FIGS. 18A-C operating on the gap between the door of FIGS. 18A-C and its frame, when the door is in an open position.

FIGS. 19A-B are sectional views of the magnetically mountable seal of FIGS. 18A-C operating on the gap between the door of FIGS. 18A-C and its frame. In FIG. 19A, the gap 15 is between the frame 20 and the door 10, which is closed. In FIG. 19B, the gap 15 is between the frame 20 and the door 10, which is open. Advantageously, when the door 10 is closed, the sealing portion 60Se, 60Si is secured to the door 10 by the magnetic portion 60Me, 60Mi so that the gap 15 is covered by the sealing portion 60Se, 60Si, and when the door 10 is opened, the door and frame 20 operate substantially as if the magnetically mountable seal 60*e,* 60*i* is not present.

Figure 20:
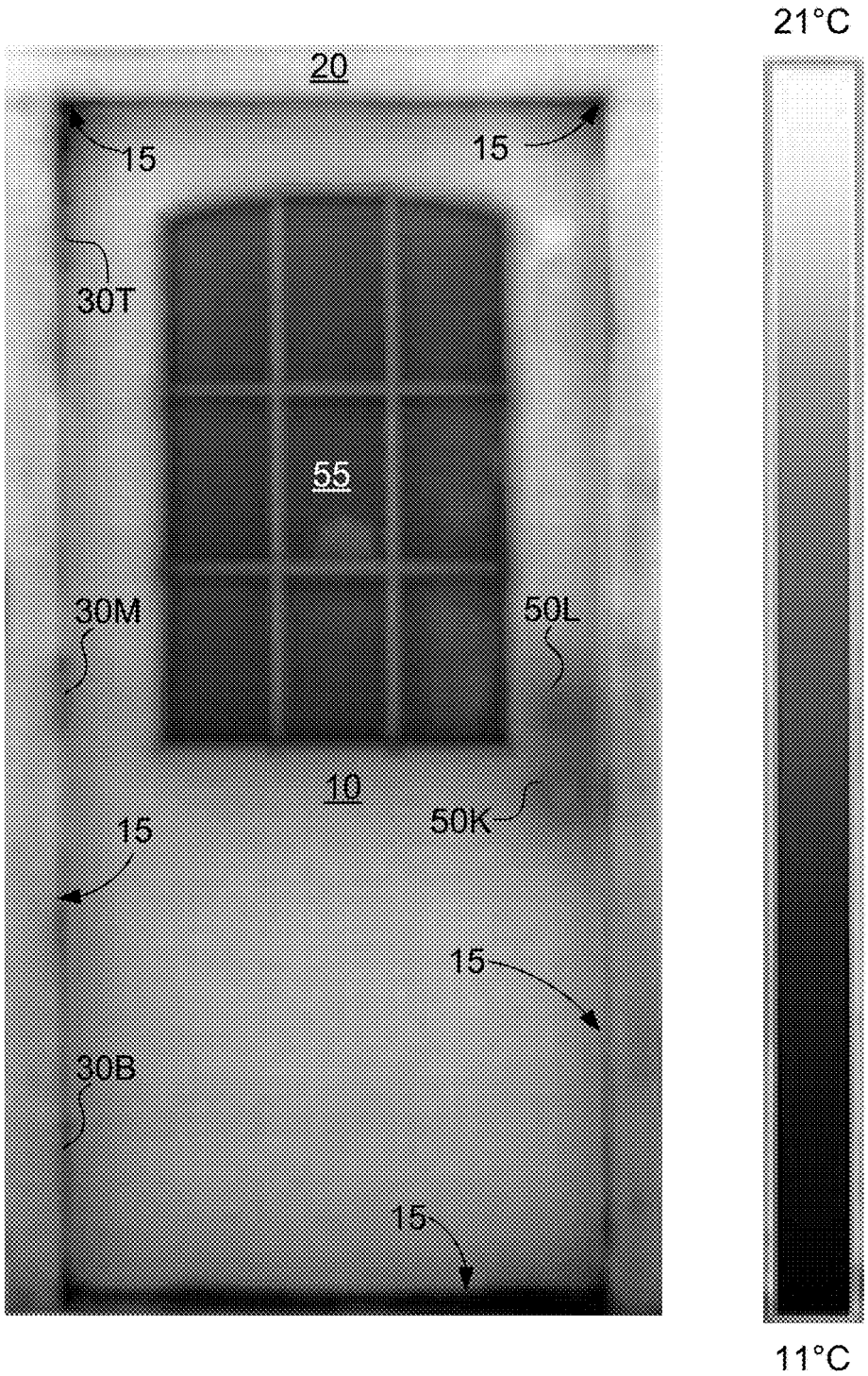
FIG. 20 is an infrared image of the frame, the door and the magnetically mountable seal of FIGS. 18A-C.

FIG. 20 is an infrared image of the frame, the door and the magnetically mountable seal of FIGS. 18A-C. The image uses shades of gray to illustrate the temperature between 11° C. (black) and 22° C. (white). The frame 20 and the door 10, as well as the hinges 30T, 30M and 30B, the lock 50L, the handle 50K, can be seen. A window 55 is located in the top part of the door 10. The gap 15 between the door 10 and the frame 20 is scarcely visible on the majority of the perimeter of the door 10 by virtue of the presence of the two magnetically mountable seals, the first invisible in the infrared, but fixed on the door on the inner side, and the second fixed to the door on the outside.

Figure 21A:
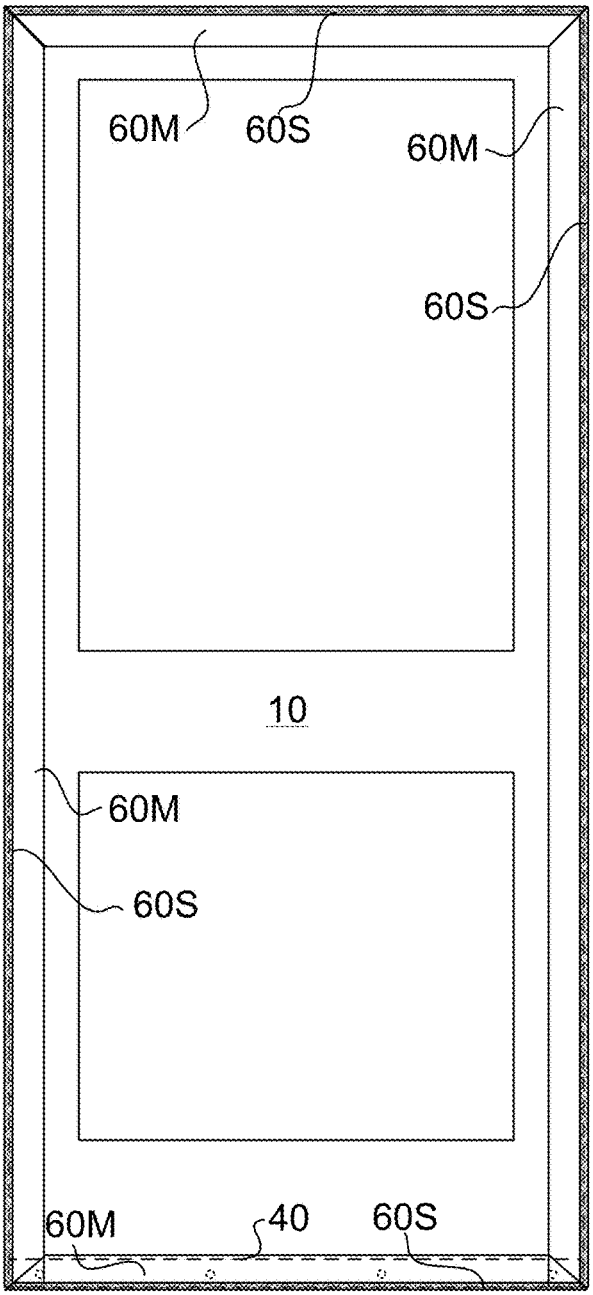
FIG. 21A is a front view of an illustration of a door including a third exemplary embodiment of a magnetically mountable seal provided in accordance with the present application.
Figure 21C:
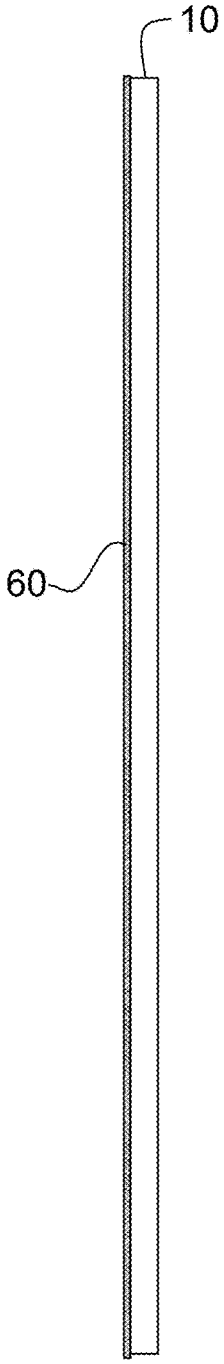
FIG. 21C is a right side view of the door and third exemplary embodiment of FIG. 21A.
Figure 21B:
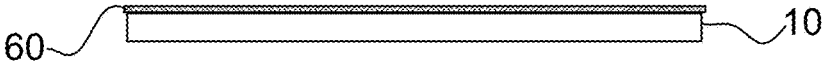
FIG. 21B is a top view of the door and third exemplary embodiment of FIG. 21A.

FIGS. 21A-C illustrate a door including a third exemplary embodiment of a magnetically mountable seal provided in accordance with the present application. As shown from the front in FIG. 21A, from the top in FIG. 21B, and from side in FIG. 21C, the door 10 has a magnetically mountable seal 60 mounted on its inner face. The magnetically mountable seal 60 includes a magnetic portion 60M and a sealing portion 60S. Advantageously, the sealing portion 60S is located in perimeter of the door 10 and will therefore serve to seal the gap between the door 10 and its associated frame and the magnetic portion 60M is located on the metal surface of the door 10 and fixes the sealing portion 60S in perimeter of the door 10. Despite the fact that there is a weatherstripping 40 at the bottom of the door, in this example the magnetically mountable seal extends to bottom of the door. This requires some adaptation that a person ordinarily skilled in the art will be able to accomplish in view of this disclosure. For example, a metal piece may be added over the weatherstrippping 40 to allow the magnetic portion 60M to attach to the bottom of the door so that the sealing portion 60S covers the gap 15 at the bottom of the door.

Figure 22A:
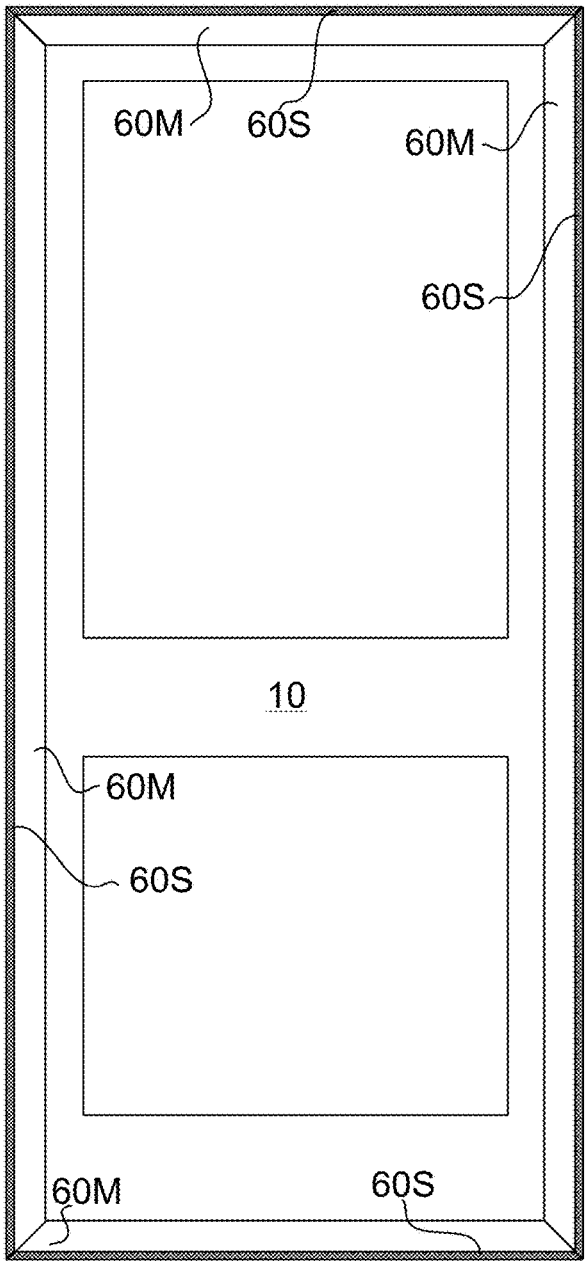
FIG. 22A is a front view of an illustration of a door including a fourth exemplary embodiment of a magnetically mountable seal provided in accordance with the present application.
Figure 22C:
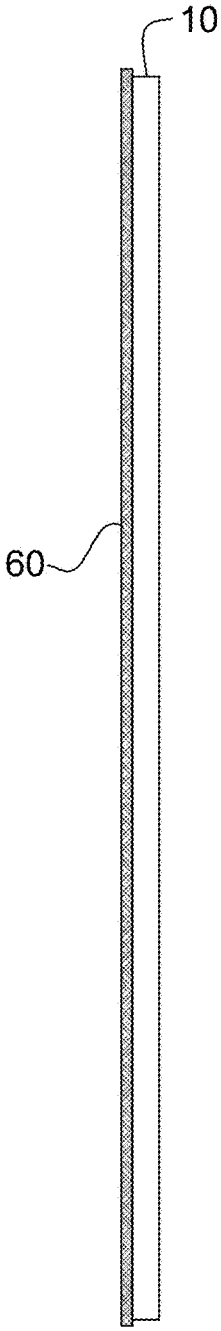
FIG. 22C is a right side view of the door and fourth exemplary embodiment of FIG. 22A.
Figure 22B:
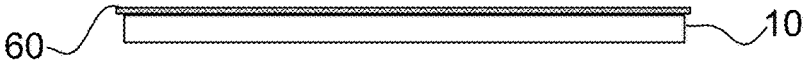
FIG. 22B is a top view of the door and fourth exemplary embodiment of FIG. 22A.

FIGS. 22A-C illustrate a door including a fourth exemplary embodiment of a magnetically mountable seal provided in accordance with the present application. As shown from the front in FIG. 22A, from the top in FIG. 22B, and from the side in FIG, 22C, the door 10 has a magnetically mountable seal 60 mounted on its inner face. The magnetically mountable seal 60 includes a magnetic portion 60M and a sealing portion 60S. Advantageously, the sealing portion 60S is located in perimeter of the door 10 and will therefore serve to seal the gap between the door 10 and its associated frame and the magnetic portion 60M is located on the metal surface of the door 10 and fixes the sealing portion 60S in perimeter of the door 10. Advantageously, the magnetically mountable seal extends on the bottom of the door. In some cases, this eliminates the need for weatherstripping at the bottom of the door.

Figure 23A:
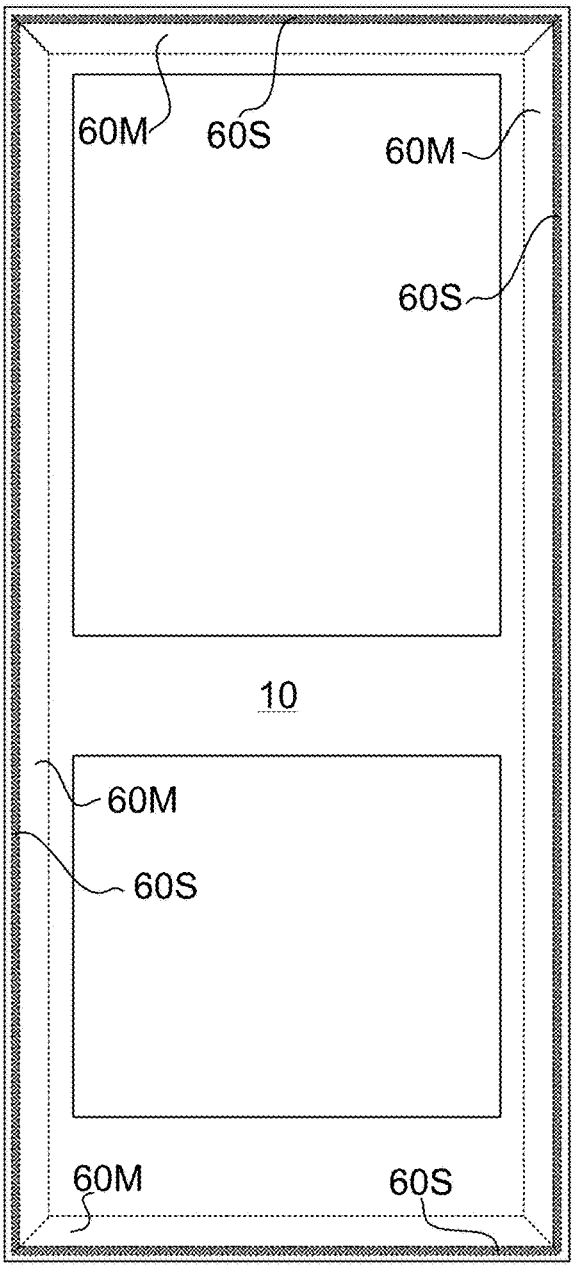
FIG. 23A is a front view of an illustration of a door including a fifth exemplary embodiment of a magnetically mountable seal provided in accordance with the present application.
Figure 23C:
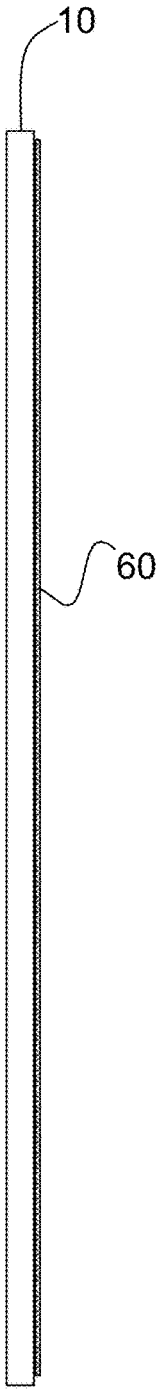
FIG. 23C is a right side view of the door and fifth exemplary embodiment of FIG. 23A.
Figure 23B:
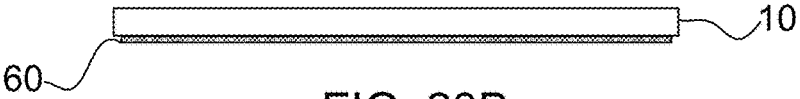
FIG. 23B is a top view of the door and fifth exemplary embodiment of FIG. 23A.

FIGS. 23A-C illustrate a door including a fifth exemplary embodiment of a magnetically mountable seal provided in accordance with the present application. As shown from the front in FIG. 23A, from the top in FIG. 23B, and from the side in FIG. 23C, the door 10 has a magnetically mountable seal 60 on its outer face. The magnetically mountable seal 60 includes a magnetic portion 60M and a sealing portion 60S. Advantageously, the sealing portion 60S is located at a distance P from the perimeter of the door 10 and will therefore serve to seal the gap between the door 10 and its associated frame and the magnetic portion 60M is located on the metal surface of the door 10 and fixes the sealing portion 60S at a distance P from the perimeter of the door 10. Advantageously, the magnetically mountable seal extends over the bottom of the door. In some cases, this eliminates the need for weatherstripping at the bottom of the door.

Figure 24A:
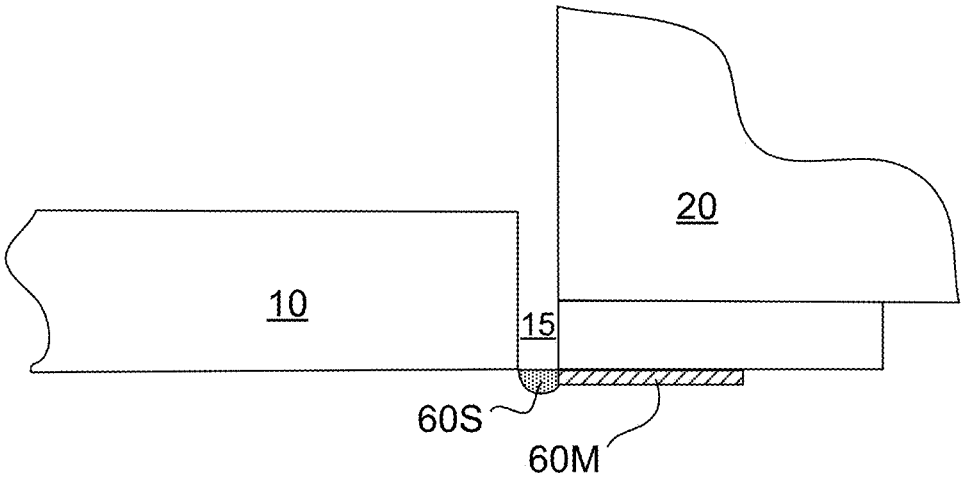
FIG. 24A is a cross-sectional view of a sixth embodiment of a magnetically mountable seal operating on the gap between a door and its frame, when the door is in an open position.
Figure 24B:
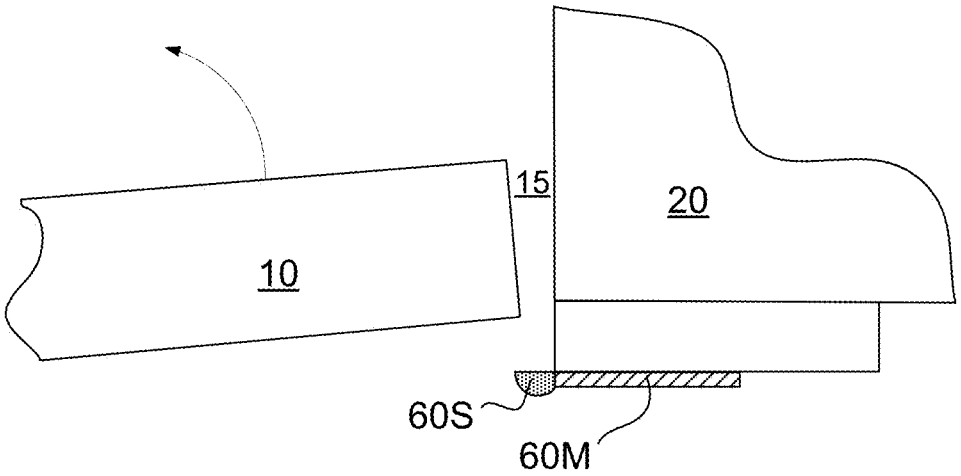
FIG. 24B is a cross-sectional view of the sixth embodiment of a magnetically mountable seal operating on the gap between a door and its frame, when the door is in a closed position.

FIGS. 24A-B are cross-sectional views of a sixth embodiment of a magnetically mountable seal operating on the gap between a door and its frame. In FIG. 24A, the gap 15 is between the frame 20 and the door 10, which is closed. In FIG. 24B, the gap 15 is between the frame 20 and the door 10, which is open. Advantageously when the door 10 is closed the sealing portion 60S is secured to the frame 20 by the magnetic portion 60M so that the gap 15 is covered by the sealing portion 60S and when the door 10 is opened, the door and the frame 20 operate substantially as if the magnetically mountable seal 60 is not present.

Figure 25A:
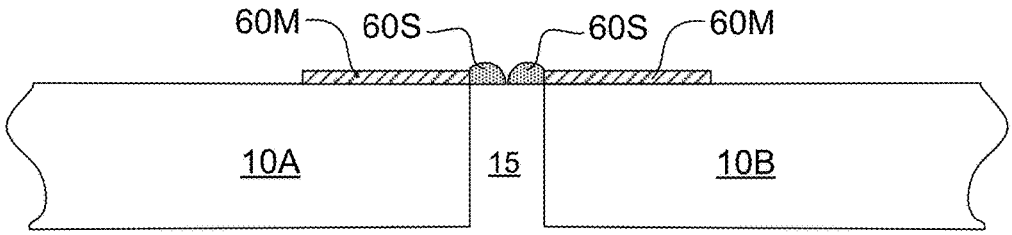
FIG. 25A is a cross-sectional view of a seventh embodiment of a magnetically mountable seal operating on the gap between a first door and a second door, when the doors are in a closed position
Figure 25B:
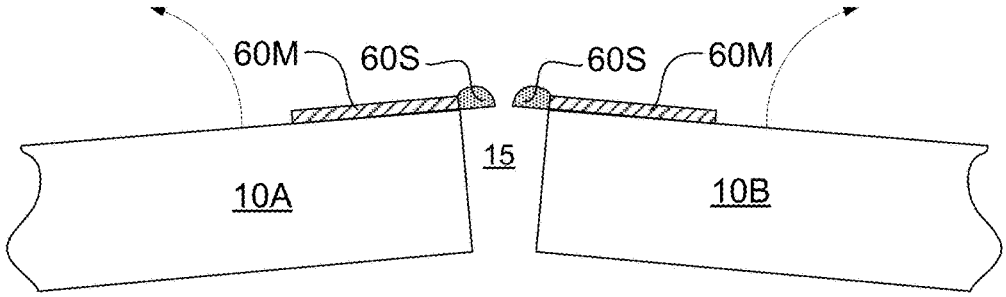
FIG. 25B is a cross-sectional view of the seventh embodiment of a magnetically mountable seal operating on the gap between the first door and the second door, when the doors are in an open position.

FIGS. 25A-B are cross-sectional views of a seventh embodiment of a magnetically mountable seal with magnetic fastening operating on the gap between a first door and a second door. In FIG. 25A, the gap 15 is between a first door 10A and a second door 10B, which are closed. In FIG. 25B, the gap 15 is between the first door 10A and the second door 10B, which are open. Advantageously, when the doors 10A, 10B are closed, the sealing portions 60S are attached to the doors 10A, 10B by the magnetic portions 60M so that the gap 15 is covered by the sealing portions 60S, and when the doors 10A, 10B are open, the doors 10A, 10B operate substantially as if the magnetically mountable seal 60 is not present.

In alternative embodiments, it is contemplated by the inventor to use the magnetically mountable seal for the following applications of insulation: thermal barrier (heat shielding, weatherstripping, air-conditioning shielding), acoustic barrier (sound dampening), hermetic barrier (air, gas), odor reducing barrier, contagion limiting barrier, and fire barrier. A person ordinarily skilled in the art will be able to adapt the present application to these applications by varying the sealing portion, e.g,by selecting a profile and a material suitable for each application while keeping the magnetic portion as such. For example, rather than employing a sealing portion made of a thermally insulating material as illustrated in the drawings, a profile and material with even more hermetic properties would be better suited for an odor-reducing or contagion-limiting application. Also for a fireproof application, the material chosen may be heat-resistant, e.g. fiberglass or asbestos.

It is envisioned by the inventor to produce the magnetically mountable seal according to various configurations which are aesthetic according to the current fashion, with materials which are durable, washable and removable. For example, the magnetically mountable seal may be covered with a layer of vinyl that matches the colors of the door or frame.

Figure 26:
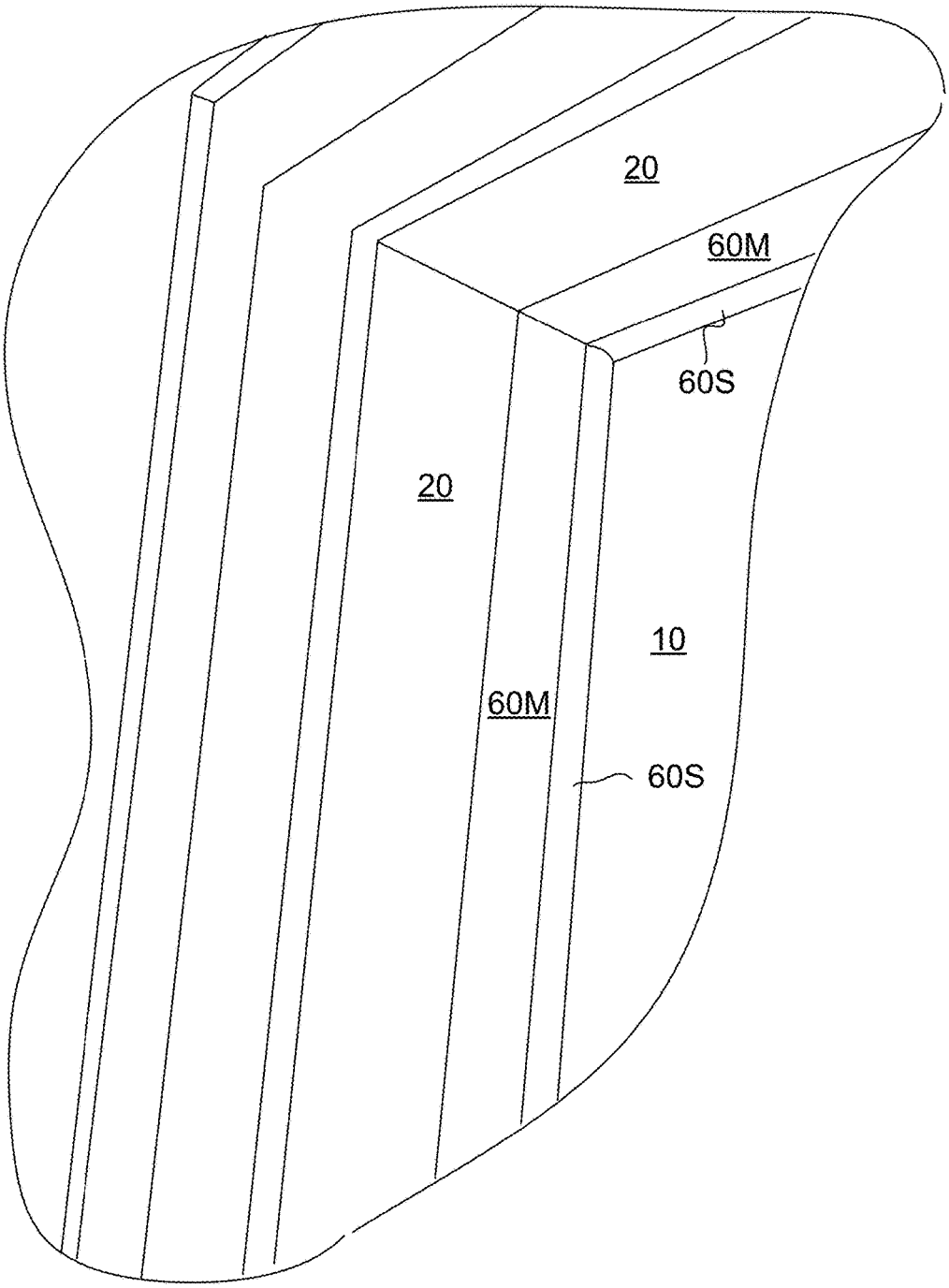
FIG. 26 is a perspective view of a first portion of an eighth embodiment of a magnetically mountable seal operating on the gap between a door and its frame.

It is envisioned by the inventor to produce the magnetically mountable seal with: a strip that covers the part of the frame between the structural work and the door of a building; this band is magnetic; the doors are either of metal or have means for enabling magnetic fastening, e.g. of metal parts. For example, FIG. 26 is a perspective view of a first portion of an eighth embodiment of a magnetically mountable seal operating on the gap between a door and its frame. As shown, the frame 20 has a magnetically mountable seal 60 on its edge face. The magnetically mountable seal includes a magnetic portion 60M and a sealing portion 60S. Advantageously, the sealing portion 60S is located on the perimeter of the door 10, and will therefore serve to seal the gap between the door 10 and its associated frame 20. The magnetic portion 60M is located on the metal surface of the frame 20 and fixes the sealing portion 60S at the perimeter of the door 10.

It is envisioned by the inventor to adapt the magnetically mountable seal for corners, hinges, handles, locks, double doors and to add additional caulking.

It is contemplated by the inventor to use the magnetically mountable seal for the inside of a door for houses, dwellings, condominiums, apartment blocks, hospitals, schools, government buildings, public buildings, private, parapublic, or any other building having at least one door.

The particular embodiments described above of the present application are exemplary only. Those ordinarily skilled in the relevant art may make alterations, modifications, adaptations, and variations in particular embodiments which will be considered part of the present application, the scope of which is limited only by the appended claims

What is claimed is:

1. A method of using a magnetically mountable seal having a magnetic portion and a sealing portion extending from a distal end of the magnetic portion for insulating a gap between a first door and one of a frame associated with the first door or a second door, said method comprising the following steps:

(a) magnetically attaching the magnetic portion to only one of a first surface of the first door or a second surface of one of the frame associated with the first door or the second door, the second surface positioned relative to the first surface in one of a substantially parallel orientation or a substantially perpendicular orientation; and (b) securing the sealing portion so that only the sealing portion covers just the gap when the first door is in a closed position and so that the sealing portion does not interfere with the functionality of the first door when the first door is in an open position.

2. A method according to claim 1, wherein a metallic material is comprised in one of said first surface or the second surface, and wherein step (a) further comprises the step of attaching said magnetic portion using the metallic material.

3. A method according to claim 1, wherein in step (b) the sealing portion extends beyond the perimeter of said first door to bear against one of the frame or the second door when said first door is in a closed position.

4. A method according to claim 1, wherein in step (b) the sealing portion extends within the perimeter of said first door to abut against one of the frame or the second door when said first door is in a closed position.

5. A method according to claim 1, wherein in step (b) the sealing portion is substantially on the perimeter of said first door for bearing against one of the frame or the second door when said first door is in a closed position.

6. The method of claim 1 further comprising the step of: (c) moving said first door from the closed position to an open position, thereby moving said sealing portion at a distance from one of the frame and the second door so that said sealing portion releases the gap while remaining attached to one of said first door or the frame; (d) moving said first door to the closed position; and (e) replacing the sealing portion to cover the gap.

7. A method according to claim 1, further comprising the step of: (g) using the sealing portion as at least one of a thermal barrier, acoustic barrier, hermetic barrier, odor barrier, contagion barrier, or fire barrier.

8. The method of claim 1, further comprising the step of: (h) covering at least a portion of the magnetically mountable seal with a vinyl layer.

* * * * *